United States Patent [19]
Sakanoue

[11] Patent Number: 5,063,145
[45] Date of Patent: Nov. 5, 1991

[54] SILVER HALIDE COLOR PHOTOGRAPHIC MATERIAL

[75] Inventor: Ken Sakanoue, Kanagawa, Japan

[73] Assignee: Fuji Photo Film Co., Ltd., Kanagawa, Japan

[21] Appl. No.: 308,504

[22] Filed: Feb. 10, 1989

[30] Foreign Application Priority Data

Feb. 10, 1988 [JP] Japan ..... 63-27602

[51] Int. Cl.[5] ..... G03C 1/43; G03C 1/46
[52] U.S. Cl. ..... 430/505; 430/393; 430/621; 430/622; 430/955
[58] Field of Search ..... 430/393, 430, 455, 621, 430/622, 505

[56] References Cited

U.S. PATENT DOCUMENTS

| | | | |
|---|---|---|---|
| 4,104,302 | 8/1978 | Smith et al. | 430/621 |
| 4,323,646 | 4/1982 | Bergthaller et al. | 430/622 |
| 4,349,624 | 9/1982 | Sobel et al. | 430/622 |
| 4,647,528 | 3/1987 | Yamada et al. | 430/621 |
| 4,770,982 | 9/1988 | Ichijima et al. | 430/505 |
| 4,842,994 | 6/1989 | Sakanoue et al. | 430/543 |
| 4,908,300 | 3/1990 | Koboshi et al. | 430/430 |

FOREIGN PATENT DOCUMENTS 0193389 2/1986 European Pat. Off. .

OTHER PUBLICATIONS

Research Disclosure, Item 11449.
Research Disclosure, Item 24241.

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A silver halide color photographic material, comprising at least one red-sensitive silver halide emulsion layer; at least one green-sensitive silver halide emulsion layer; and at least one blue-sensitive silver halide emulsion layer, wherein the layers are coated on a support and the photosensitive material comprises at least one compound which reacts with the oxidation products of color developing agents during development and releases a bleach accelerator, and the swelling factor of the photosensitive material in the development bath is at least 2.8.

14 Claims, No Drawings

SILVER HALIDE COLOR PHOTOGRAPHIC MATERIAL

FIELD OF THE INVENTION

This invention concerns a silver halide color photographic material. More precisely, the invention concerns silver halide color photographic materials which have improved desilvering properties.

BACKGROUND OF THE INVENTION

Basically, silver halide color photographic materials are processed by means of a color development process and a desilvering process. Thus, the exposed silver halide is reduced with a color developing agent to produce silver in the color developing process and the oxidized color developing agent reacts with a color forming agent (coupler) to provide a dye image. The silver which is formed at this time is then oxidized by means of a bleaching agent, converted into a soluble silver complex by the action of a fixing agent, and dissolved out and removed in the desilvering process.

In recent years, strong demands have arisen in the industry for more rapid processing. Specifically, it is important to shorten the time required for processing, and, in particular, to shorten the desilvering process which accounts for about half of the processing time.

Bleach-fix baths in which an amino polycarboxylic acid Fe(III) complex and a thiosulfate are contained in the same bath as disclosed in the specification of German Patent 866,605 were known in the past as a means of speeding up the desilvering process. However, originally, amino polycarboxylic acid Fe(III) complex salts which had a weak oxidizing power (bleach power) and thiosulfates which had a reducing power were present together. Thus, the bleaching power was remarkably weak and it was very difficult to desilver adequately high speed, high silver content camera photosensitive materials and, therefore, these baths could not be used in practice.

On the other hand, methods in which various bleaching accelerators are added to the bleach bath, bleach-fix bath of the bleach or bleach fix prebaths have been suggested as methods of increasing bleaching power. Bleaching accelerators of this type include various mercapto compounds such as those disclosed in U.S. Pat. No. 3,893,858, British Patent 1,138,842 and JP-A-53-141623 (the term "JP-A" as used herein refers to a "published unexamined Japanese patent application"), compounds which have disulfide bonds such as those disclosed in JP-A-53-95630, thiazolidine derivatives such as those disclosed in JP-B-53-9854 (the term "JP-B" as used herein refers to an "examined Japanese patent publication"), isothiourea derivatives such as those disclosed in JP-A-53-94927, thiourea derivatives such as those disclosed in JP-B-45-8506 and JP-B-49-26586, thioamido compounds such as those disclosed in JP-A-49-42349, dithiocarbamates such as those disclosed in JP-A-55-26506, and arylenediamine compounds such as those disclosed in U.S. Pat. No. 4,552,834.

Furthermore, methods in which processing is carried out with mercapto compounds or precursors thereof from among the aforementioned bleach accelerators present in the photosensitive material are also known. However, in cases where the mercapto compounds are included in the photosensitive material, the compounds may have a pronounced effect on the photographic properties. Further, sparingly soluble salts may be formed from the mercapto compounds and the silver halide in the undeveloped parts of the photosensitive material. Thus, there are many problems associated with these methods.

On the other hand, disclosures concerning bleach accelerator releasing couplers have been made in *Research Disclosure*, Items Nos. 24241 and 11449, and in the specification of JP-A-61-201247 (corresponding to EP-A-193389). These documents disclose that the bleaching rate is increased when a bleach accelerator releasing coupler is used.

However, the increase in the bleaching rate is limited, even when the above-mentioned bleach accelerator releasing couplers are used, and thus, a satisfactory level has not been reached in practice. Furthermore, if the bleaching time is shortened by adding larger amounts there are clear side effects, such as loss of speed, due to the leaving groups.

SUMMARY OF THE INVENTION

Therefore, an object of the present invention is to provide a silver halide color photographic material in which bleach accelerator releasing couplers are used and which have bleaching rate sufficiently high for practical purposes even when processed in rapid processing baths which have a bleaching function.

The above-mentioned object of the present invention has been attained by means of a silver halide color photographic material, comprising:

at least one red-sensitive silver halide emulsion layer;

at least one green-sensitive silver halide emulsion layer; and at least one blue-sensitive silver halide emulsion layer, wherein said layers are coated on a support and wherein said photosensitive material comprises at least one compound which reacts with the oxidation products of color developing agents during development and releases a bleach accelerator, and wherein the swelling factor of said photosensitive material in the development bath is at least 2.8.

In this invention, the swelling factor in the development bath signifies the value obtained by dividing the film thickness after swelling in the development bath (the film thickness of the photographic layer on the side of the support where the photosensitive layers are located) by the dry film thickness.

Measurements of the thickness of the film swelled in the development bath is achieved using the method described by A. Green and G.I.P. Levenson in *J. Phot. Sci.*, 20, 205 (1972). That is to say, it can be obtained from the equilibrium value of the swelled film thickness in development bath which is being maintained at 38° C. The formulation indicated in the illustrative example is used for the development bath.

The bleach accelerator releasing type compounds used in the present invention are described in detail below.

The compounds which can be represented by general formula (I) indicated below are preferred for the compounds which release bleach accelerators in this invention.

$$A-(L)_p-Z \qquad (I)$$

wherein A represents a group whose bond with $(L)_p-Z$ is cleaved by reaction with the oxidized form of a developing agent, L is selected from the group consisting of a timing group and a group whose bond with Z is cleaved by reaction with the oxidized form of a developing agent, p represents an integer having a value of from 0 to 3, wherein when p is 2 or 3, the L groups may be the same or different, and Z represents a group which exhibits a bleach accelerating action when the bond between Z and $A—(L)_p$ is cleaved.

Moreover, compounds which can be represented by general formula (I') below are more preferred.

$$A—(L_1)_a—(L_2)_b—Z \quad (I')$$

wherein A represents a group whose bond with $(L_1)_a—(L_2)_b—Z$ is cleaved by reaction with the oxidized form of a developing agent, $L_1$ is selected from the group consisting of a timing group and a group whose bond with $(L_2)_b—Z$ is cleaved by reaction with the oxidized form of a developing agent, $L_2$ is selected from the group consisting of a timing group and a group whose bond with Z is cleaved by reaction with the oxidized form of a developing agent, Z represents a group which exhibits a bleach accelerating action when the bond between Z and $A—(L_1)_a—(L_2)_b$ has been cleaved, and a and b each represents 0 or 1.

DETAILED DESCRIPTION OF THE INVENTION

More precisely, A in general formulas (I) and (I') represents a coupler residual group or a redox group.

Any known coupler residual group can be used for the coupler residual group which is represented by A. For example, it may be a yellow coupler residual group (for example, an open chain ketomethylene type coupler residual group), a magenta coupler residual group (for example, a 5-pyrazolone type, pyrazoloimidazole type or pyrazolotriazole type coupler residual group), a cyan coupler residual group (for example, a phenol type or naphthol type coupler residual group) or a non-coloring coupler residual group (for example, an indanol type or acetophenone type coupler residual group). Furthermore, A may be a heterocyclic type coupler residual group disclosed in U.S. Pat. Nos. 4,315,070, 4,183,752, 3,961,959 and 4,171,223.

Preferred examples of the coupler residual group A, when A represents the coupler residual group in general formula (I'), are those which can be represented by general formulas (Cp-1), (Cp-2), (Cp-3), (Cp-4), (Cp-5), (Cp-6), (Cp-7), (Cp-8), (Cp-9), or (Cp-10) indicated below.

These couplers have a high coupling rate and are preferred.

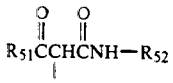
(Cp-1)

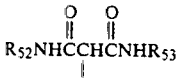
(Cp-2)

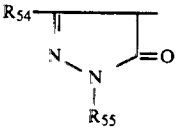
(Cp-3)

-continued

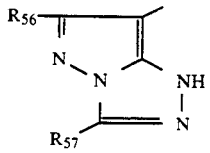
(Cp-4)

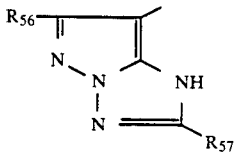
(Cp-5)

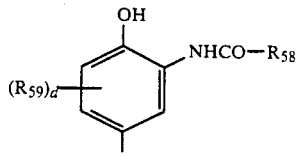
(Cp-6)

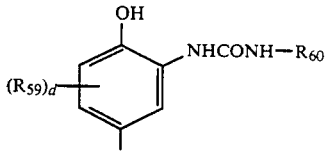
(Cp-7)

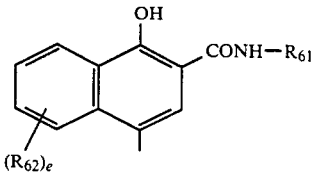
(Cp-8)

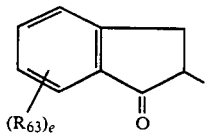
(Cp-9)

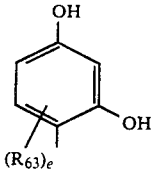
(Cp-10)

The free bonds originating from the coupling positions in the above formulas indicate the bonding position of the coupling releasable group.

In cases where, in these formulas, $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ include groups which are diffusion resistant, they are selected in such a way that the total number of carbon atoms is from 8 to 40, and preferably from 10 to 30. In other cases the total number of carbon atoms is preferably not more than 15.

In the case of dimeric, telomeric and polymeric couplers, some of the above-mentioned substituents represent divalent groups through which the repeating units are linked together. In such a case, the number of carbon atoms may be outside the range specified above for the number of carbon atoms.

The substituents $R_{51}$ to $R_{63}$, d and e are described in detail below. Here, $R_{41}$ represents an aliphatic group, aromatic group or heterocyclic group, $R_{42}$ represents an aromatic group or heterocyclic group, and $R_{43}$, $R_{44}$ and $R_{45}$ represent hydrogen atoms, aliphatic groups or aromatic groups.

$R_{51}$ has the same significance as $R_{41}$. $R_{52}$ and $R_{53}$ each has the same significance as $R_{42}$. $R_{54}$ has the same significance as $R_{41}$ or it represents an $R_{41}CON(R_{43})$— group, an $R_{41}N(R_{43})$— group, an $R_{41}SO_2N(R_{43})$— group, an $R_{41}S$— group, an $R_{43}O$— group, an $R_{45}N(R_{43})$—CO—$N(R_{44})$— group or an N≡C— group. $R_{55}$ has the same significance as $R_{41}$. $R_{56}$ and $R_{57}$ each has the same significance as $R_{43}$ or they represent an $R_{41}S$— group, an $R_{43}O$— group, an $R_{41}CON(R_{43})$— group or an $R_{41}SO_2N(R_{43})$— group.

$R_{58}$ has the same significance as $R_{41}$. $R_{59}$ has the same significance as $R_{41}$ or it represents an $R_{41}CON(R_{43})$— group, an $R_{41}OCON(R_{43})$— group, an $R_{41}SO_2N(R_{43})$— group, an $R_{43}N(R_{44})$—CO—$N(R_{45})$— group, an $R_{41}O$— group, an $R_{41}S$— group, a halogen atom or an $R_{41}N(R_{43})$— group, moreover, d represents an integer having a value of from 0 to 3. When d is 2 or more, the individual $R_{59}$ substituent groups may be the same group or a different group. Furthermore, the $R_{59}$ groups may be divalent groups which are joined together to form a cyclic structure. The groups indicated below are typical examples of divalent groups for forming cyclic structures.

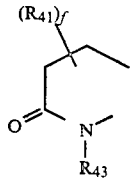
group or
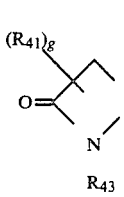
group

Here, f is an integer having a value of from 0 to 4, and g is an integer having a value of from 0 to 2. $R_{60}$ has the same significance as $R_{41}$, $R_{61}$ has the same significance as $R_{41}$, $R_{62}$ has the same significance as $R_{41}$, or represents an $R_{41}CONH$— group, an $R_{41}OCONH$— group, an $R_{41}SO_2NH$— group, an $R_{43}N(R_{44})$—CO—$N(R_{45})$— group, an $R_{43}N(R_{44})$—$SO_2$—$N(R_{45})$— group, an $R_{43}O$— group, an $R_{41}S$— group, a halogen atom, or an $R_{41}N(R_{43})$— group.

$R_{63}$ has the same significance as $R_{41}$, or it represents an $R_{43}CON(R_{45})$— group, an $R_{43}NCO(R_{44})$— group, an $R_{41}SO_2N(R_{44})$— group, an $R_{43}NSO_2(R_{44})$— group, an $R_{41}SO_2$— group, an $R_{43}OCO$— group, an $R_{43}O$—$SO_2$— group, a halogen atom, a nitro group, a cyano group or an $R_{43}CO$— group. Moreover, e represents an integer having a value of from 0 to 4. When there are two or more $R_{62}$ groups or $R_{63}$ groups these groups may be the same or different, respectively.

The aliphatic groups referred to above are saturated or unsaturated, open chain or cyclic, straight chain or branched chain, substituted or unsubstituted, aliphatic hydrocarbon groups which have from 1 to 32, and preferably from 1 to 22, carbon atoms. Methyl, ethyl, propyl, isopropyl, butyl, tert-butyl, isobutyl, tertamyl, hexyl, cyclohexyl, 2-ethylhexyl, octyl, 1,1,3,3-tetramethylbutyl, decyl, dodecyl, hexadecyl and octadecyl are typical examples of such groups.

The aromatic groups are preferably substituted or unsubstituted phenyl groups, or substituted or unsubstituted naphthyl groups, which have from 6 to 20 carbon atoms.

The heterocyclic groups are preferably 3- to 8-membered, substituted or unsubstituted heterocyclic groups which contain from 1 to 20, preferably from 1 to 7 carbon atoms and hetero atoms selected from among nitrogen, oxygen and sulfur atoms. Thus, 2-pyridyl, thionyl, 2-furyl, 1-imidazolyl, 1-indolyl, phthalimido, 1,3,4-thiadiazol-2-yl, 2-quinolyl, 2,4-dioxo-1,3-indazolidin-5-yl, 2,4-dioxo-1,3-imidazolidin-3-yl, succinimido, 1,2,4-triazol-2-yl and 1-pyrazolyl are typical examples of such heterocyclic groups.

Halogen atoms, $R_{47}O$— groups, $R_{46}S$— groups, $R_{47}CON(R_{48})$— groups, $R_{47}NCO(R_{48})$— groups, $R_{46}OCON(R_{47})$— groups, $R_{46}SO_2N(R_{47})$— groups, -continued $R_{47}N(R_{48})SO_2$— groups, $R_{46}SO_2$— groups, $R_{47}OCO$— groups, $R_{47}N(R_{48})$—CO—$N(R_{49})$— groups, groups which have the same significance as $R_{46}$,

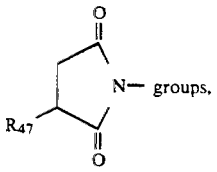

$R_{46}COO$— groups, $R_{47}OSO_2$— groups, cyano groups and nitro groups are typical substituent groups when the aforementioned aliphatic hydrocarbyl groups, aromatic groups and heterocyclic groups have substituent groups, where $R_{46}$ represents an aliphatic group, an aromatic group, or a heterocyclic group, and $R_{47}$, $R_{48}$ and $R_{49}$ each represents an aliphatic group, an aromatic group, a heterocyclic group or a hydrogen atom. Here, the significance of the terms aliphatic group, aromatic group and heterocyclic group is the same as described earlier.

The preferred range for $R_{51}$ to $R_{63}$, d and e is described below.

$R_{51}$ is preferably an aliphatic group or an aromatic group. $R_{52}$, $R_{53}$ and $R_{55}$ are preferably aromatic groups. $R_{54}$ is preferably an $R_{41}CONH$— group or an $R_{41}$—$N(R_{43})$— group.

$R_{56}$ and $R_{57}$ are preferably aliphatic groups, $R_{41}O$— groups or $R_{41}S$— groups. $R_{58}$ is preferably an aliphatic group or an aromatic group. In general formula (Cp-6), $R_{59}$ is preferably a chlorine atom, an aliphatic group or an $R_{41}CONH$— group. The value of d is preferably 1 or 2. $R_{60}$ is preferably an aromatic group. In general formula (Cp-7), $R_{59}$ is preferably an $R_{41}CONH$— group. The value of d in general formula (Cp-7) is preferably 1. $R_{61}$ is preferably an aliphatic group or an aromatic group. In general formula (Cp-8), the value of e is preferably 0 or 1. $R_{62}$ is preferably an $R_{41}OCONH$— group, an $R_{41}CONH$— group or an $R_{41}SO_2NH$— group, and these substituent groups are preferably substituted in the 5-position of the naphthol ring. In general formula (Cp-9), $R_{63}$ is preferably an $R_{43}CONH$— group, an $R_{41}SO_2NH$— group, an $R_{43}N(R_{44})SO_2$— group, an $R_{41}SO_2$— group, an $R_{43}N(R_{44})CO$— group, a nitro group or a cyano group. In general formula (Cp-10), $R_{63}$ is preferably an $R_{43}N(R_{44})CO$— group, an $R_{43}OCO$— group or an $R_{43}CO$— group.

Typical examples of $R_{51}$ to $R_{63}$ are indicated below.

$R_{51}$ may be a tert-butyl, 4-methoxyphenyl, phenyl, 3-[2-(2,4-di-tert-amylphenoxy)butanamido]phenyl, or methyl group.

$R_{52}$ and $R_{53}$ may be a 2-chloro-5-dodecyloxycarbonylphenyl, 2-chloro-5-hexadecylsulfonamidophenyl, 2-chloro-5-tetradecanamidophenyl, 2-chloro-5-[4-(2,4-ditert-amylphenoxy)butanamido]phenyl, 2-chloro-5-[2-(2,4-di-tert-amylphenoxy)butanamido]phenyl, 2-methoxyphenyl, 2-methoxy-5-tetradecyloxycarbonylphenyl, 2-chloro-5-(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl, or 2-ethoxyphenyl group.

$R_{54}$ may be a 3-[2-(2,4-di-tert-amylphenoxy)butanamido]benzamido, 3-[4-(2,4-di-tert-amylphenoxy)butanamido]benzamido, 2-chloro-5-tetradecanamidoanilino, 5-(2,4-di-tert-amylphenoxyacetamido)benzamido, 2-chloro-5-dodecenylsuccinimidoanilino, 2-chloro-5-[2-(3-tertbutyl-4-hydroxyphenoxy)tetradecanamido]anilino, 2,2-dimethylpropanamido, 2-(3-pentadecylphenoxy)butanamido, pyrrolidino or N,N-dibutylamino group.

The 2,4,6-trichlorophenyl, 2-chlorophenyl, 2,5-dichlorophenyl, 2,3-dichlorophenyl, 2,6-dichloro-4methoxyphenyl, 4-[2-(2,4-di-tert-amylphenoxy)butanamido]phenyl and 2,6-dichloro-4-methanesulfonylphenyl groups are preferred examples of $R_{55}$.

$R_{56}$ may be a methyl, ethyl, isopropyl, methoxy, ethoxy, methylthio, ethylthio, 3-phenylureido or 3-(2,4-di-tert-amylphenoxy)propyl group.

$R_{57}$ may be a 3-(2,4-di-tert-amylphenoxy)propyl, 3-[4-{2-[4-(4-hydroxyphenylsulfonyl)phenoxy]tetradecanamido}phenyl]propyl, methoxy, methylthio, ethylthio, methyl, 1-methyl-2-{2-octyloxy-5-[2-octyloxy-5-(1,1,3,3-tetramethylbutyl)phenylsulfonamido]phenylsulfonamido}ethyl, 3-[4-(4-dodecyloxyphenylsulfonamido)phenyl]propyl, 1,1-dimethyl-2-[2-octyloxy-5-(1,1,3,3-tetramethylbutyl)phenylsulfonamido]ethyl, or dodecylthio group.

$R_{58}$ may be a 2-chlorophenyl, pentafluorophenyl, heptafluoropropyl, 1-(2,4-di-tert-amylphenoxy)propyl, 3-(2,4-di-tert-amylphenoxy)propyl, 2,4-di-tert-amylphenoxymethyl or furyl group.

$R_{59}$ may be a chlorine atom or a methyl, ethyl, propyl, butyl, isopropyl, 2-(2,4-di-tert-amylphenoxy)butanamido, 2-(2,4-di-tert-amylphenoxy)hexanamido, 2-(2,4-tert-octylphenoxy)octanamido, 2-(2-chlorophenoxy)tetradecanamido, 2-[4-(4-hydroxyphenylsulfonyl)phenoxy]tetradecanamido or 2-[2-(2,4-di-tert-amylphenoxyacetamido)phenoxy]butanamido group.

$R_{60}$ may be a 4-cyanophenyl, 2-cyanophenyl, 4-butylsulfonylphenyl, 4-propylsulfonylphenyl, 4-chloro-3-cyanophenyl, 4-ethoxycarbonylphenyl or 3,4-dichlorophenyl group.

$R_{61}$ may be a dodecyl, hexadecyl, cyclohexyl, 3-(2,4-di-tert-amylphenoxy)propyl, 4-(2,4-di-tert-amylphenoxy)butyl, 3-dodecyloxypropyl, t-butyl, 2-methoxy-5-dodecyloxycarbonylphenyl or 1-naphthyl group.

$R_{62}$ may be an isobutyloxycarbonylamino, ethoxycarbonylamino, phenylsulfonylamino, methanesulfonamido, benzamido, trifluoroacetamido, 3-phenylureido, butoxycarbonylamino or acetamido group.

$R_{63}$ may be a 2,4-di-tert-amylphenoxyacetamido, 2-(2,4-di-tert-amylphenoxy)butanamido, hexadecylsulfonamido, N-methyl-N-octadecylsulfamoyl, N,N-dioctylsulfamoyl or a 4-tert-octylbenzoyl, dodecyloxycarbonyl group, a chlorine atom, or a nitro, cyano, N-[4-(2,4-di-tert-amylphenoxy)butyl]carbamoyl, N-3-(2,4-di-tert-amylphenoxy)propylsulfamoyl, methanesulfonyl or hexadecylsulfonyl group.

When A in general formula (I') represents a redox group, this can be represented more particularly by general formula (II) indicated below.

$$A_1—P—(X{=}Y)_n—Q—A_2 \qquad (II)$$

In this formula, P and Q each independently represents an oxygen atom or a substituted or unsubstituted imino group, and at least one of the n individual X and Y groups represents a methine group which has a group represented by $—(L_1)_a—(L_2)_b—Z$ as a substituent group and the other X and Y groups represent substituted or unsubstituted methine groups or nitrogen atoms, n is an integer having a value of from 1 to 3 (the n individual X groups and n individual Y groups may be the same or different), and $A_1$ and $A_2$ each represents a hydrogen atom or a group which can be removed with an alkali. Cases in which any two of the substituent groups P, X, Y, Q, $A_1$ and $A_2$ are divalent groups and are joined together to form a ring are also included here. For example, $(X{=}Y)_n$ may form a benzene ring or a pyridine ring.

When P and Q represent substituted or unsubstituted imino groups, they are preferably imino groups which are substituted with sulfonyl groups or acyl groups.

In such a case, P and Q can be represented as follows.

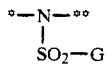
(N-1)

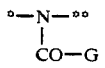
(N-2)

Here, * indicates the position at which $A_1$ or $A_2$ is bonded and ** indicates the position at which one of the free bonds of $—X{=}Y_n$ is bonded.

The group represented by G in these formulas is preferably a straight chain, branched chain or cyclic, saturated or unsaturated, substituted or unsubstituted, aliphatic group which has from 1 to 32, and preferably from 1 to 22, carbon atoms (for example, methyl, ethyl, benzyl, phenoxybutyl, isopropyl), a substituted or unsubstituted aromatic group which has from 6 to 10 carbon atoms (for example, phenyl, 4-methylphenyl, 1-naphthyl, 4-dodecyloxyphenyl), or a 4- to 7-membered heterocyclic group in which the hetero atom is selected from among the nitrogen, sulfur and oxygen atoms (for example, 2-pyridyl, 1-phenyl-4-imidazolyl, 2-furyl, benzothienyl).

P and Q in general formula (II) are preferably each independently an oxygen atom or a group which can be represented by general formula (N-1).

When $A_1$ and $A_2$ represent groups which can be removed with an alkali (referred to below as precursor groups), they are preferably groups which can be hydrolyzed, such as acyl groups, alkoxycarbonyl groups, aryloxycarbonyl groups, carbamoyl groups and sulfonyl groups, precursor groups of the type in which reverse Michael reactions are used as disclosed in U.S. Pat. No. 4,009,029, precursor groups of the type in which anions which are formed after a ring opening reaction are used as intramolecular nucleophilic groups as disclosed in U.S. Pat. No. 4,310,612, precursor groups in which an anion undergoes electron transfer via a conjugated system and a cleavage reaction is brought about thereby as disclosed in U.S. Pat. Nos. 3,674,478, 3,932,480 and 3,993,661, precursor groups in which the cleavage reaction is brought about by electron transfer of the anion which has reacted after ring-opening as disclosed in U.S. Pat. No. 4,335,200, or precursor groups in which an imidomethyl group is used as disclosed in U.S. Pat. Nos. 4,363,865 and 4,410,618.

P in general formula (II) preferably represents an oxygen atom, and $A_2$ preferably represents a hydrogen atom.

Preferably, in general formula (II), at least one of the n individual X and Y groups is a methine group having $—(L_1)_a—(L_2)_b—Z$ as a substituent and the other X and Y groups each is an unsubstituted methine group or a methine group substituted by a substituent other than $—(L_1)_a—(L_2)_b—Z$.

Of the groups which are represented by general formula (II), particularly preferred groups are represented by general formulas (III) or (IV).

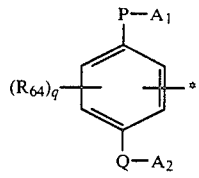
(III)

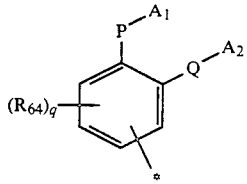
(IV)

In these formulas, * indicates the position at which the $—(L_1)_a—(L_2)_b—Z$ group is bonded, and P, Q, $A_1$ and $A_2$ have the same significance as described for general formula (II), $R_{64}$ represents a substituent group, and q represents 0 or an integer having a value of from 1 to 3. When q is 2 or more, then the $R_{64}$ groups may be the same or different, and when two $R_{64}$ groups are present as substituent groups on adjacent carbon atoms they may be divalent groups which are joined together to form a ring structure. At this time a condensed benzene ring is formed, forming, for example, a naphthalene, benzonorbornene, chroman, indole, benzothiophene, quinoline, benzofuran, 2,3-dihydrobenzofuran, indane or an indene, and these may have one or more further substituent groups. The preferred substituent groups when these condensed rings have substituent groups, and preferred examples of $R_{64}$ in cases where the $R_{64}$ groups do not form a condensed ring, are indicated below. Thus, the preferred groups are an $R_{41}$ group, a halogen atom, an $R_{43}O$— group, an $R_{43}S$— group, an $R_{43}NCO$— group, ($R_{44}$)

an $R_{43}OOC$— group, an $R_{41}SO_2$— group, an $R_{43}NSO_2$— group, ($R_{44}$) and $R_{43}CON$— group, ($R_{43}$)

an $R_{41}SO_2N$— group, ($R_{43}$)

an $R_{43}CO$— group, an $R_{41}COO$— group, an $R_{43}N$—CO—N— group, ($R_{44}$, $R_{45}$)

a cyano group, or a

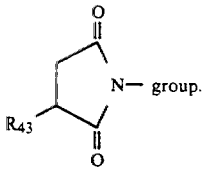

Here, $R_{41}$, $R_{43}$, $R_{44}$ and $R_{45}$ have the same significance as described earlier. Typical examples of the $R_{64}$ group include a methyl, ethyl, tert-butyl, methoxy, methylthio, dodecylthio, 3-(2,4-di-tertamylphenoxy)-propylthio, N-3-(2,4-di-tert-amylphenoxy)propylcarbamoyl, N-methyl-N-octadecyloxycarbamoyl, methoxycarbonyl, dodecyloxycarbonyl, propylcarbamoyl, hydroxyl or N,N-dioctylcarbamoyl group. Groups which can be represented by the formula indicated below are examples of ring structures which have been formed by two $R_{64}$ groups.

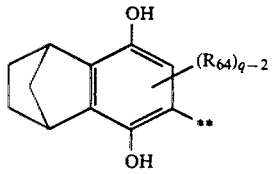

P and Q in general formulas (III) and (IV) preferably represent oxygen atoms.

$A_1$ and $A_2$ in general formulas (III) and (IV) preferably represent hydrogen atoms.

The groups represented by $L_1$ and $L_2$ in general formula (I') may or may not be used in the invention.

It is desirable that these groups should not be used, but they may be selected according to the intended purpose. When $L_1$ and $L_2$ represent timing groups, they may consist, for example, of the known linking groups indicated below:

(1) Groups in which the cleavage reaction of a hemiacetal is used:

These have been disclosed, for example, in U.S. Pat. No. 4,146,396, JP-A-60-249148 and JP-A-60-249149, and they are groups which can be represented by general formula (T-1) indicated below. Here * indicates the position at which they are bonded on the left hand side in general formula (I'), and ** indicates the position at which they are bonded on the right hand side in general formula (I').

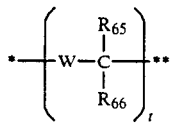

(T-1)

In this formula, W represents an oxygen atom, a sulfur atom or an

—N— group, ($R_{67}$)

$R_{65}$ and $R_{66}$ represent hydrogen atoms or substituent groups, $R_{67}$ represents a substituent group and t represents 1 or 2. When t is 2, then the two —W—C— groups ($R_{65}$, $R_{66}$)

may be the same or different. Typical examples of $R_{65}$ and $R_{66}$ when they are substituent groups, and of $R_{67}$, include an $R_{69}$— group, an $R_{69}CO$— group, an $R_{69}SO_2$— group, an $R_{69}NCO$— group, ($R_{70}$) and an $R_{69}NSO_2$— group. ($R_{70}$)

Here, $R_{69}$ is a group which has the same significance as the $R_{41}$ group described earlier, and $R_{70}$ is a group which has the same significance as $R_{43}$. $R_{65}$, $R_{66}$ and $R_{67}$ may each be divalent groups and these may be joined together to form ring structures. Groups such as those indicated below are specific examples of groups which can be represented by general formula (T-1).

*—$OCH_2$—**

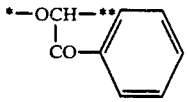

*—$SCH_2$—**

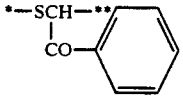

-continued

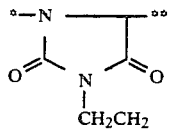

(2) Groups in which a cleavage reaction is brought about using an intramolecular nucleophilic substitution reaction:

For example, there are the timing groups disclosed in U.S. Pat. No. 4,248,962. These can be represented by general formula indicated below.

$$*\text{—Nu—Link—E-}^{**} \qquad \text{(T-2)}$$

In this formula, * indicates the position at which it is bonded on the left hand side in general formula (I'), and  indicates the position at which it is bonded on the right hand side in general formula (II), Nu represents a nucleophilic group, e.g., an oxygen atom or a sulfur atom. E is an electrophilic group, this being a group which is subjected to nucleophilic attack by Nu and cleaves the bond indicated by the , and Link is a linking group which establishes a steric arrangement of the groups Nu and E such that an intramolecular nucleophilic substitution reaction can occur. Specific examples of groups which can be represented by general formula (T-2) are indicated below.

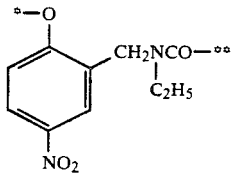

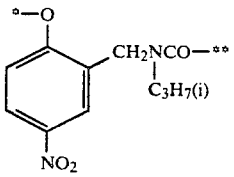

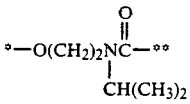

(3) Groups in which the cleavage reaction is brought about using an electron transfer reaction along a conjugated system:

These have been disclosed, for example, in U.S. Pat. Nos. 4,409,323 and 4,421,845, and they are groups which can be represented by the general formula indicated below.

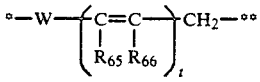

(T-3)

In this formula, *, **, W, $R_{65}$, $R_{66}$ and t have the same significance as described in connection with general formula (T-1). Specific examples of such groups are indicated below.

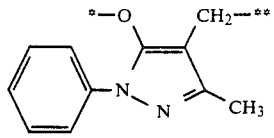

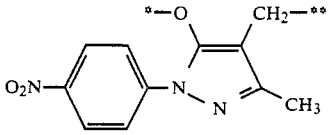

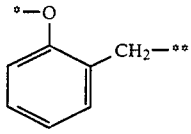

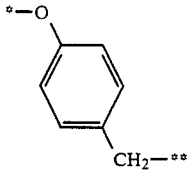

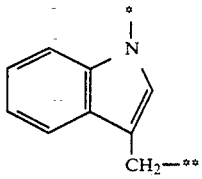

(4) Groups in which a cleavage reaction due to ester hydrolysis is used:

There are, for example, the linking groups disclosed in West German Patent (Laid Open) 2,626,315, and these groups are indicated below. In these formulas, * and ** have the same significance as described in connection with general formula (T-1).

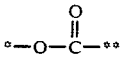

(T-4)

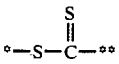

(T-5)

(5) Groups in which the cleavage reaction of an imino ketal is used:

There are the linking groups disclosed, for example, in U.S. Pat. No. 4,456,073, and these groups can be represented by the general formula indicated below.

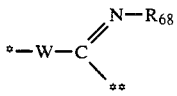

(T-6)

In this formula, *, **, and W have the same significance as described in connection with general formula (T-1) and $R_{68}$ has the same significance as $R_{67}$. Specific examples of groups which can be represented by general formula (T-6) are indicated below.

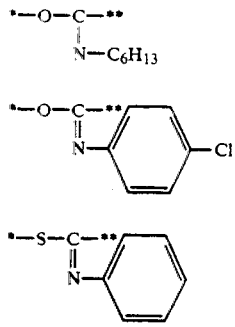

When the group represented by $L_1$ in general formula (I') is a group which reacts with the oxidized form of a developing agent after cleavage from A and is cleaved from the group $(L_2)_b$—Z, it represents, more precisely, a group which forms a coupler or a redox group after cleavage from A. Similarly, when the group represented by $L_2$ is a group which reacts with the oxidized form of a developing agent after cleavage from A—$(L_1)_b$ and is cleaved from the group Z, it is, more precisely, a group which forms a coupler or a redox group after cleavage from the group A—$(L_1)_b$.

In the case where the group which forms a coupler is a phenol type coupler, for example, this is bonded to A— or A—$(L_1)_b$— at the oxygen atom obtained by removing the hydrogen atom of the hydroxyl group. Furthermore, in the case of 5-pyrazolone type coupler, this is bonded to A— or A—$(L_1)_b$— at the oxygen atom obtained by removing the hydrogen atom from the hydroxyl group of the tautomeric 5-hydroxypyrazole form. In such cases, this is eliminated from A— or A—$(L_1)_b$— initially to form a phenol type coupler or a 5-pyrazolone type coupler. These have an $(L_2)_b$—Z group or a Z group at the coupling position.

When $L_1$ and $L_2$ represent groups which form couplers, the preferred groups are those which can be represented by general formulas (V), (VI), (VII), and (VIII) indicated below. In these formulas, * indicates the position at which the group is bonded on the left hand side in general formula (I) and ** indicates the position at which the group is bonded on the right hand side in general formula (I).

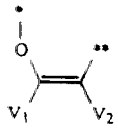

(V)

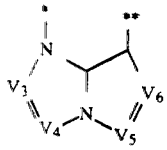

(VI)

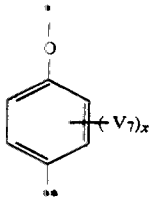

(VII)

-continued

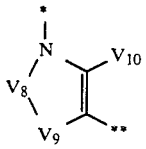

(VIII)

In these formulas, $V_1$ and $V_2$ represent substituent groups, $V_3$, $V_4$, $V_5$ and $V_6$ represent nitrogen atoms, or substituted or unsubstituted methine groups, $V_7$ represents a substituent group, x represents an integer having a value of from 0 to 4, and when x is 2 or more, the $V_7$ groups may be the same or different, and the $V_7$ groups may be joined together to form a ring structure. $V_8$ represents a —CO— group, an —$SO_2$— group, a nitrogen atom or a substituted imino group, $V_9$ represents a group of nonmetal atoms which is required together with

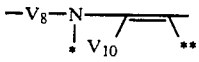

to form a 5- to 8-membered ring, and $V_{10}$ represents a hydrogen atom or a substituent group. However, $V_1$ and $V_2$ may each represent a divalent linking group which may be joined together to form, together with

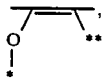

a 5- to 8-membered ring.

$V_1$ preferably represents an $R_{71}$ group, and the $R_{72}$— group, $R_{72}CO$— group,

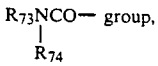

$R_{72}SO_2$— group, $R_{72}S$— group, $R_{72}O$— group and the

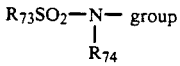

are preferred for $V_2$. Examples of cases in which $V_1$ and $V_2$ are joined together to form a ring include indenes, indoles, pyrazoles, and benzothiophenes.

The preferred substituents, when $V_3$, $V_4$, $V_5$ and $V_6$ represent substituted methine groups, are $R_{71}$ groups, $R_{73}O$— groups, $R_{71}S$— groups and $R_{71}CONH$— groups.

$V_7$ preferably represents a halogen atom, $R_{71}$ group, $R_{71}CONH$— group, $R_{71}SO_2NH$— group, $R_{73}O$— group, $R_{71}S$— group,

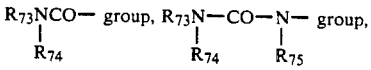

$R_{71}CO$— group, or an $R_{73}OOC$— group. Naphthalenes, quinolines, oxyindoles, benzodiazepine-2,4-diones, benzimidazol-2-ones and benzothiophenes are examples of ring structures formed by the joining together of a plurality of $V_7$ groups.

When $V_8$ represents a substituted imino group, it is preferably an

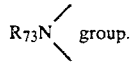

The preferred ring structures formed by $V_9$ with

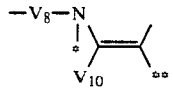

are indoles, imidazolinones, 1,2,5-thiadiazolin-1,1-dioxides, 3-pyrazolin-5-ones or 3-isooxazolin-5-ones.

The $R_{73}$ group, $R_{73}O$— group,

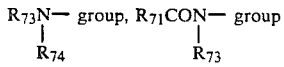

and the $R_{71}S$— group are preferred for $V_{10}$.

In the descriptions given above, $R_{71}$ and $R_{72}$ represent aliphatic groups, aromatic groups or heterocyclic groups, and $R_{73}$, $R_{74}$ and $R_{75}$ represent hydrogen atoms, aliphatic groups, aromatic groups or heterocyclic groups. Here, the terms aliphatic group, aromatic group and heterocyclic group have the same significance as described earlier in connection with $R_{41}$. Furthermore, the total number of carbon atoms contained in these groups is preferably not more than 10.

The groups indicated below are typical example of groups represented by general formula (V).

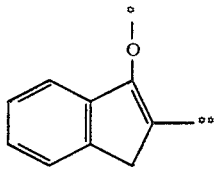

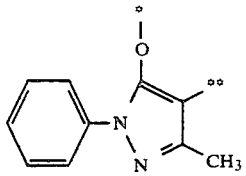

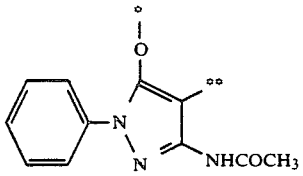

-continued

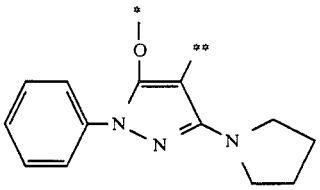

The groups indicated below are typical examples of groups represented by general formula (VI).

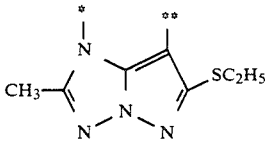

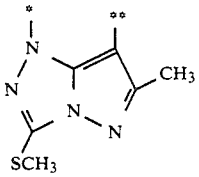

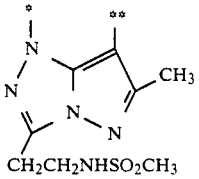

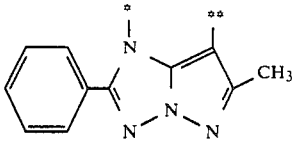

The groups indicated below are typical examples of groups represented by general formula (VII).

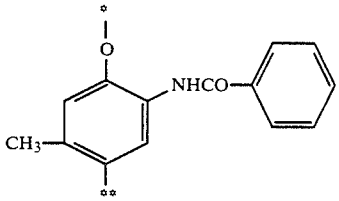

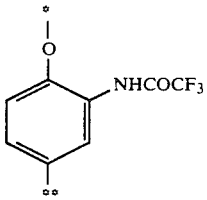

-continued

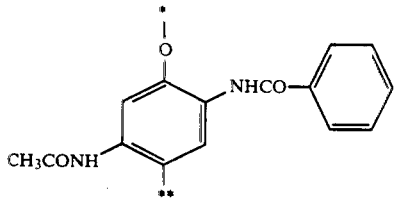

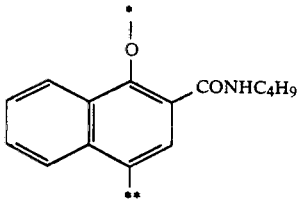

The groups indicated below are typical examples of groups represented by general formula (VIII).

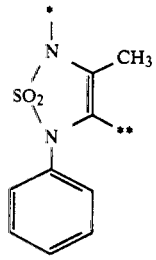

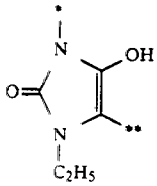

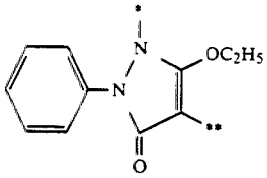

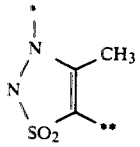

When the groups represented by $L_1$ and $L_2$ in general formula (I') are redox groups, they are preferably groups which can be represented by general formulas (X) or (XI) indicated below.

(X)

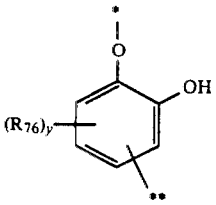

-continued (XI)

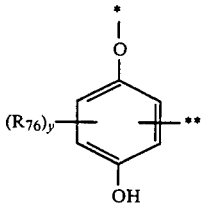

In these formulas, * signifies the position of the bonding on the left hand side of $L_1$ and $L_2$ in general formula (I') and ** indicates the position of the bonding on the right hand side. $R_{76}$ has the same significance as $R_{64}$ described in connection with general formulas (III) and (IV). Moreover, y represents an integer having a value of from 0 to 3, and when y is 2 or more, the $R_{76}$ groups may be the same or different. Furthermore, cases where two $R_{76}$ groups are joined together to form a ring structure are also included.

Examples of the most desirable groups for $R_{76}$ include alkoxy groups (for example, methoxy, ethoxy), acylamino groups (for example, acetamido, benzamido), sulfonamido groups (for example, methanesulfonamido, benzenesulfonamido), alkylthio groups (for example, methylthio, ethylthio), carbamoyl groups (for example, N-propylcarbamoyl, N-tert-butylcarbamoyl, N-isopropylcarbamoyl), alkoxycarbonyl groups (for example, methoxycarbonyl, propoxycarbonyl), aliphatic groups (for example, methyl, tert-butyl), halogen atoms (for example, fluoro, chloro), sulfamoyl groups (for example, N-propylsulfamoyl, sulfamoyl), acyl groups (for example, acetyl, benzoyl), hydroxyl groups, or carboxyl groups. Furthermore, the group indicated below is a typical example of a case in which two $R_{76}$ groups are joined together to form a ring structure.

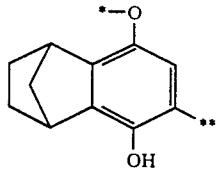

Here, * and ** have the same significance as described in connection with general formula (XI).

The group represented by Z in general formula (I') is a known bleach accelerator residual group. For example, it may be one of various mercapto compounds such as those disclosed in U.S. Pat. No. 3,893,858, British Patent 1,138,842 or JP-A-53-141623, a compound which has disulfide bonds such as those disclosed in JP-A-53-95630, a thiazolidine derivative such as those disclosed in JP-B-53-9854, an isothiourea derivative such as those disclosed in JP-A-53-94927, a thiourea derivative such as those disclosed in JP-B-45-8506 and JP-B-49-26586, a thioamido compound such as those disclosed in JP-A-49-42349, a dithiocarbamate such as those disclosed in JP-A-55-26506, or an arylenediamine compound such as those disclosed in U.S. Pat. No. 4,552,834. Preferred examples of these groups are those which are bonded to $A—(L_1)_a—(L_2)_b—$ in general formula (I') through a hetero atom which is contained in the molecule.

Groups which can be represented by general formula (XII), (XIII) or (XIV) indicated below are preferred for the group which is represented by Z.

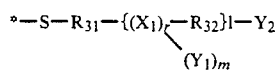

(XII)

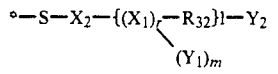

(XIII)

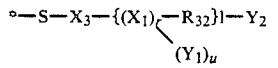

(XIV)

In these formulas, * indicates the position of the bonding with the $A—(L_1)—(L_2)_b—$ group, $R_{31}$ represents a divalent aliphatic group which has from 1 to 8, and preferably from 1 to 5, carbon atoms, $R_{32}$ has the same significance as $R_{31}$ and further represents a divalent aromatic group which has from 6 to 10 carbon atoms, or a 3- to 8-membered, and preferably a 5- or 6-membered, divalent heterocyclic group, $X_1$ represents —O—, —S—, —COO—, $—SO_2—$,

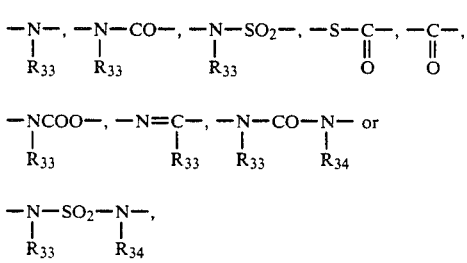

$X_2$ represents an aromatic group which has from 6 to 10 carbon atoms, $X_3$ represents a 3- to 8-membered, and preferably a 5- or 6-membered, heterocyclic group which has at least one carbon atom, which is bonded to sulfur, in the ring, $Y_1$ represents a carboxyl group or a salt thereof, a sulfo group or a salt thereof, a hydroxyl group, a phosphonic acid group or a salt thereof, an amino group which may be substituted with aliphatic groups which have from 1 to 4 carbon atoms, an $—NH—SO_2—R_{35}$ group or an $—SO_2NH—R_{35}$ group (here the term "salt" signifies a salt such as a sodium salt, a potassium salt or an ammonium salt), $Y_2$ represents a group which has the same significance as $Y_1$ or a hydrogen atom, r represents 0 or 1, l represents an integer having a value of from 0 to 4, m represents an integer having a value of from 1 to 4, and u represents an integer having a value of from 0 to 4. However, the m individual $Y_1$ groups are bonded at the substitutable positions of $R_{31}—\{(X_1)_r—R_{32}\}_l$, $X_2—\{(X_1)_r—R_{32}\}_l$, and $X_3—\{(X_1)_r—R_{32}\}_l$, respectively, and when m is 2 or more, the individual $Y_1$ groups may be the same or different, and when l is 2 or more, the l individual $\{(X_1)_r—R_{32}\}$ groups may be the same or different. Here, $R_{33}$, $R_{34}$ and $R_{35}$ each represents a hydrogen atom or an aliphatic group which has from 1 to 8, and preferably from 1 to 5, carbon atoms. When the groups represented by $R_{31}$ to $R_{35}$ represent aliphatic groups, these may be chain like or cyclic, straight chain or branched chain, saturated or unsaturated, substituted or unsubstituted, aliphatic groups. Unsubstituted groups are preferred, but they may have, for example, halogen atoms, alkoxy groups (for example, methoxy, ethoxy) or alkylthio groups (for example, methylthio, ethylthio) as substituent groups.

The aromatic groups represented by $X_2$ and the aromatic groups when $R_{32}$ represents an aromatic group may have substituent groups. For example, they may have the aforementioned substituent groups described for the aliphatic groups as substituent groups.

The heterocyclic groups represented by $X_3$ and the heterocyclic groups when $R_2$ represents a heterocyclic group are saturated or unsaturated, substituted or unsubstituted, heterocyclic groups which have oxygen atoms, sulfur atoms or nitrogen atoms as the hetero atoms. For example, they may be pyridine rings, imidazole rings, piperidine rings, oxirane rings, sulfolane rings, imidazolidine rings, thiazepine rings, or pyrazole rings. The aforementioned substituent groups described as substituent groups for aliphatic groups are examples of substituent groups for these heterocyclic groups.

Specific examples of groups which can be represented by general formula (XII) are indicated below.

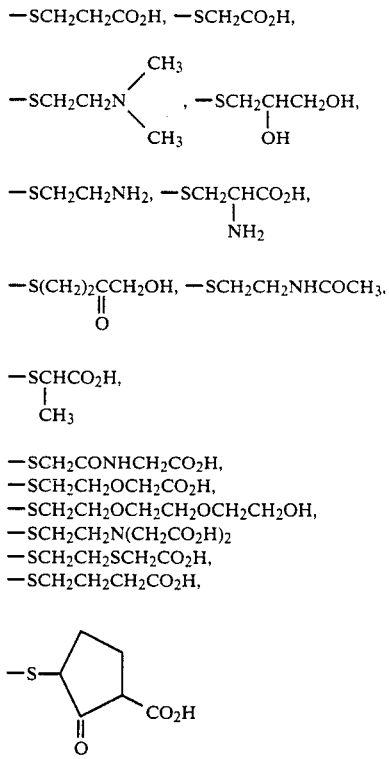

Specific example of groups which can be represented by general formula (XIII) are indicated below.

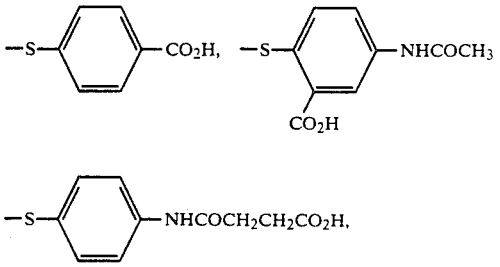

-continued

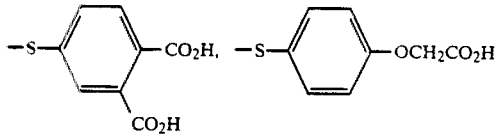

Specific example of groups which can be represented by general formula (XIV) are indicated below.

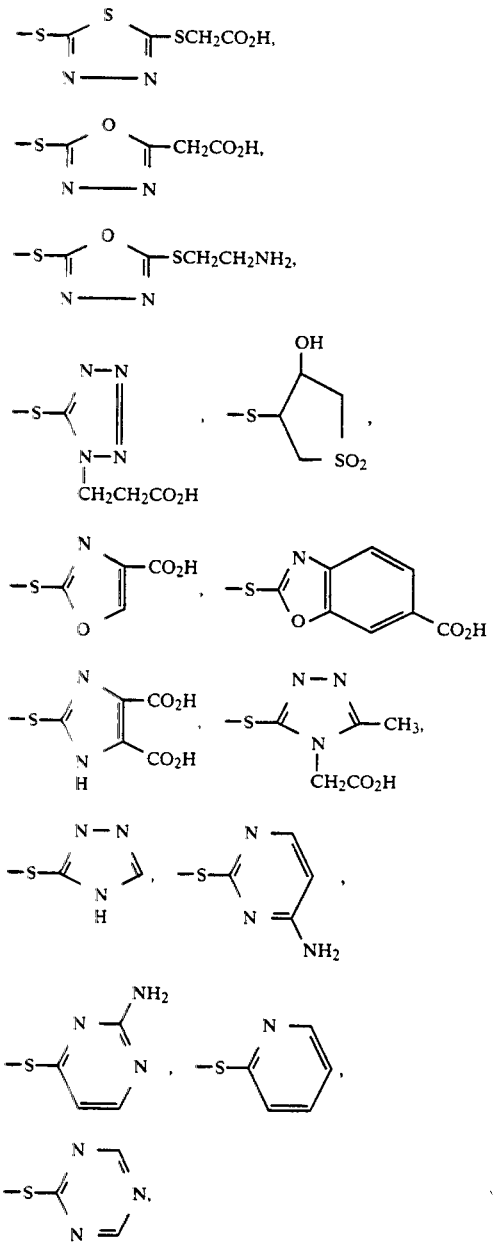

The compounds represented by general formula (I') of this invention include dimeric forms, telomeric forms, and polymeric forms. For example, polymeric forms include polymers derived from a monomer represented by general formula (XV) indicated below which have a repeating unit represented by general formula (XVI), and copolymers derived from the said monomers with at least one type of non-color-forming monomer which has at least one ethylene group which does not have the capacity for coupling with the oxidized form of a primary aromatic amine developing agent. Here, two or more types of monomers represented by general formula (XV) can be polymerized at the same time:

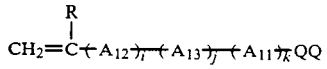

(XV)

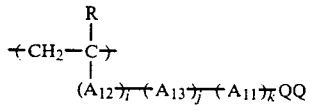

(XVI)

In these formulas, R represents a hydrogen atom, a lower alkyl group which has from 1 to 4 carbon atoms, or a chlorine atom, $A_{11}$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—, $A_{12}$ represents —CONH— or —COO—, and $A_{13}$ represents an unsubstituted or substituted alkylene group which has from 1 to 10 carbon atoms, an aralkylene group, or an unsubstituted or substituted arylene group, and the alkylene groups may be straight chain or branched chain type groups. Examples of alkylene groups include methylene, methylmethylene, dimethylmethylene, dimethylene, trimethylene, tetramethylene, pentamethylene, hexamethylene and decylmethylene, examples of aralkylene groups include benzylidene, and examples of arylene groups include phenylene and naphthalene.

QQ represents a compound residual group which can be represented by general formula (I'), and these may be bonded at any position except the group represented by Z of the substituent groups described earlier.

Moreover, i, j and k represent 0 or 1, but they cannot all represent 0 at the same time.

Here, the substituent groups for the alkylene, aralkylene or arylene groups represented by $A_{13}$ are aryl groups (for example, phenyl), nitro groups, hydroxyl groups, cyano groups, sulfo groups, alkoxy groups (for example, methoxy), aryloxy groups (for example, phenoxy), acyloxy groups (for example, acetoxy), acylamino groups (for example, acetylamino), sulfonamido groups (for example, methanesulfonamido), sulfamoyl groups (for example, methylsulfamoyl), halogen atoms (for example, fluorine, chlorine, bromine), carboxyl groups, carbamoyl groups (for example, methylcarbamoyl), alkoxycarbonyl groups (for example, methoxycarbonyl) and sulfonyl groups (for example, methylsulfonyl). When there are two or more substituent groups these groups may be the same or different.

Next, the non-color-forming ethylenic monomer which does not couple with the oxidized form of a primary aromatic amine developing agent, may be, for example, acrylic acid, α-chloroacrylic acid, α-alkylacrylic acid, or esters or amides derived from these acrylic acids, methylenebisacrylamide, vinyl esters, acrylonitrile, aromatic vinyl compounds, maleic acid derivatives, vinylpyridines, etc. Two or more types of the non-colorforming ethylenic unsaturated monomers can be used at the same time.

Cases in which there is a second bond between any two of the groups represented by A, $L_1$, $L_2$, and Z in general formula (I') other than the bonds shown in general formula (I') are also included. The effect of the invention can be obtained even if the second bonds are not broken during development. Examples of bonds of this type are indicated below.

$A-L_1-(L_2)_b-Z$ $A-L_1-L_2-Z$ $A-(L_1)_2-L_2-Z$

Among those indicated above, especially desirable examples are represented by general formula (XVII) below.

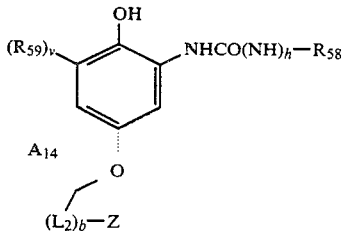

(XVII)

In this formula, $L_2$, b, Z, $R_{58}$ and $R_{59}$ have the same significance as described earlier, h and v each represents 0 or 1, and $A_{14}$ represents a divalent organic residual group which forms a 5- to 8-membered ring.

Examples of $A_{14}$ include

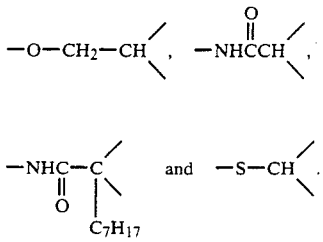

Specific examples of compounds which release bleaching accelerators which can be used in the invention are indicated below, but the invention is not limited to these examples.

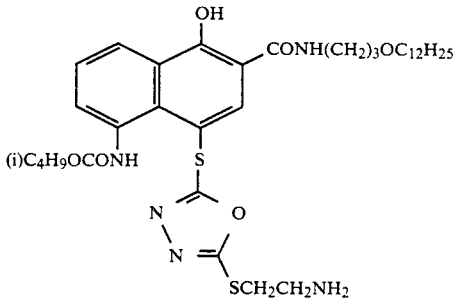

(B-1)

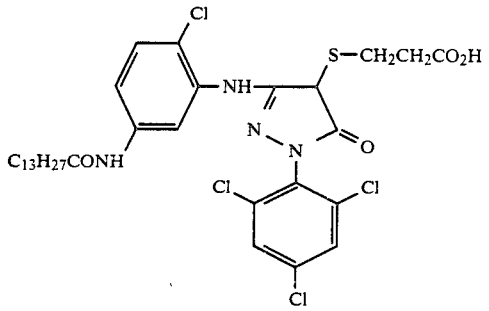

(B-2)

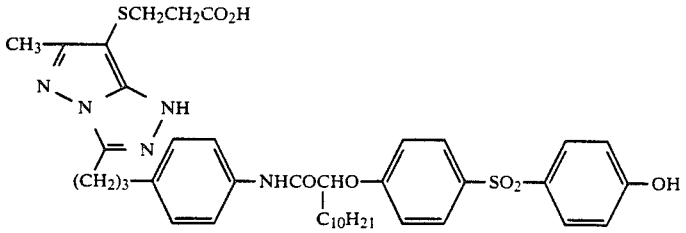

(B-3)

-continued
(B-4)
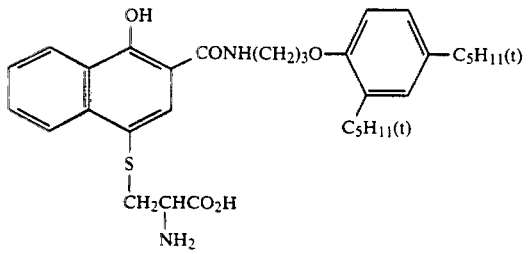
(B-5)
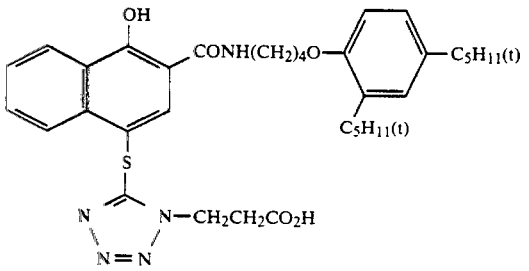
(B-6)
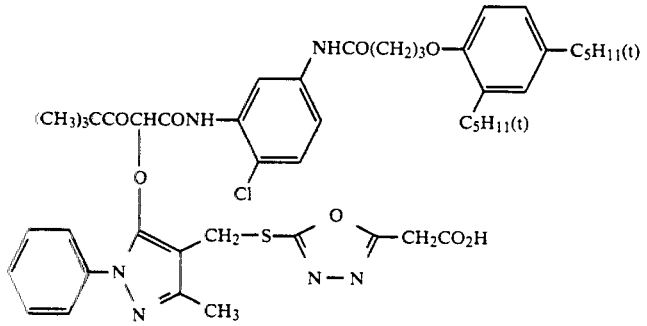
(B-7)
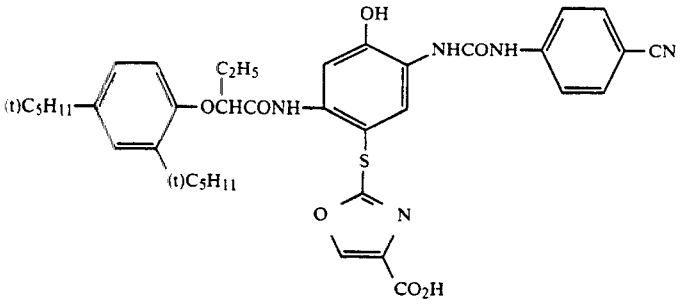
(B-8)
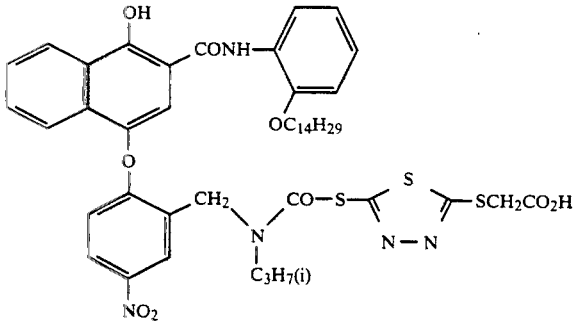

-continued
(B-9)
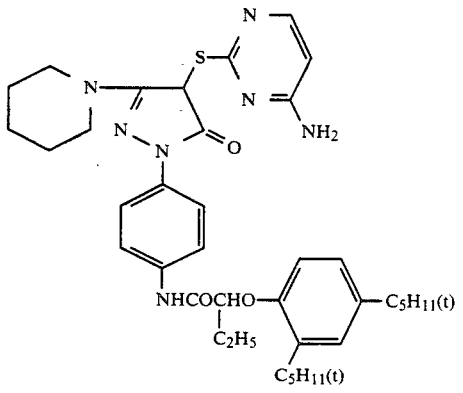
(B-10)
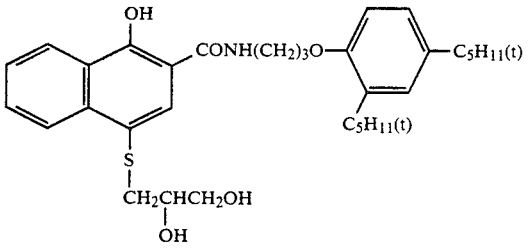
(B-11)
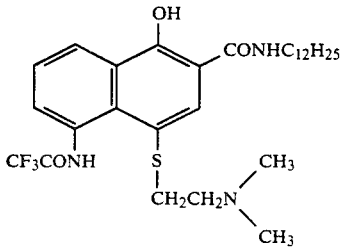
(B-12)
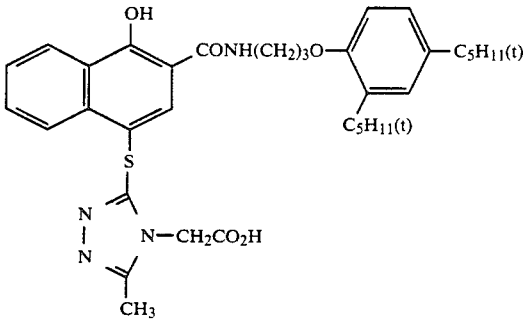
(B-13)
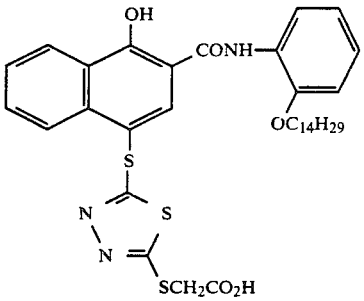

-continued
(B-14)
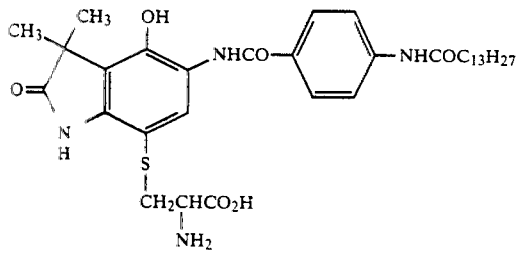
(B-15)
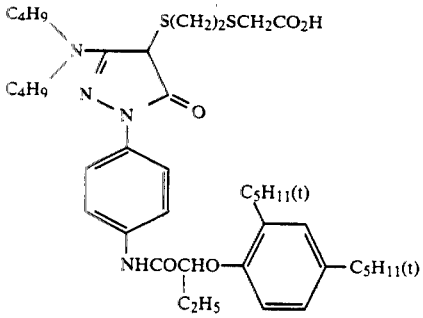
(B-16)
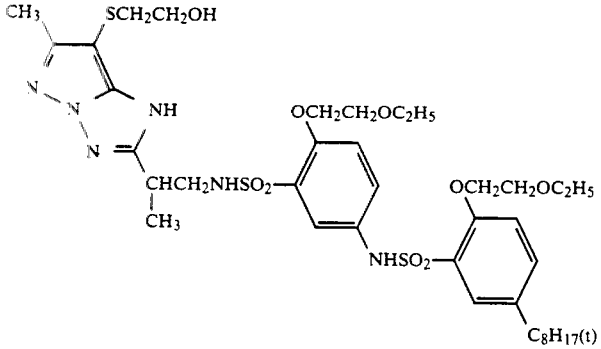
(B-17)
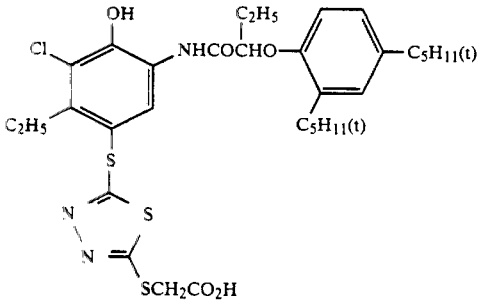
(B-18)
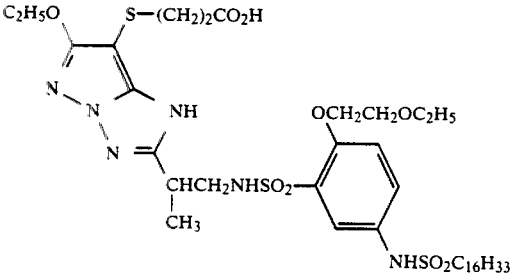

-continued
(B-19)
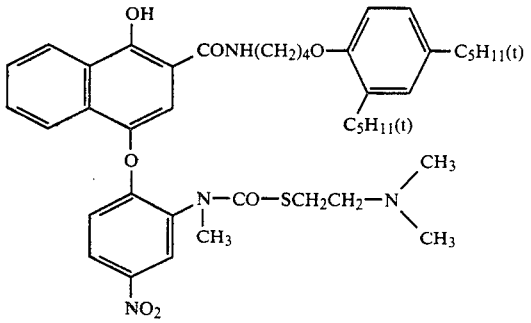
(B-20)
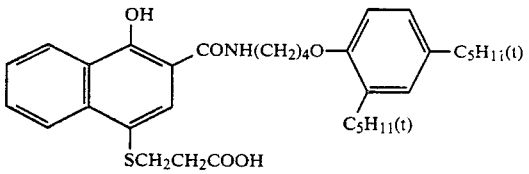
(B-21)
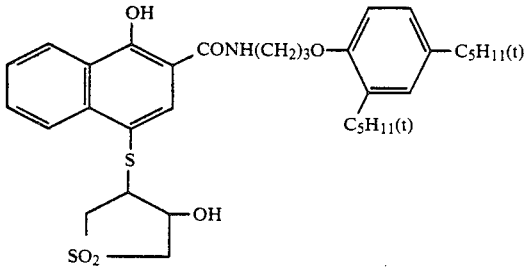
(B-22)
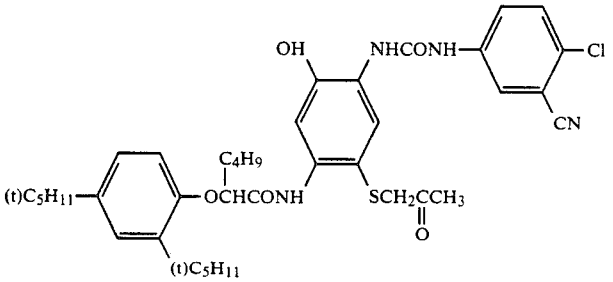
(B-23)
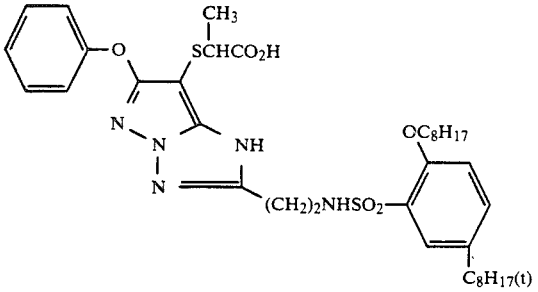
(B-24)
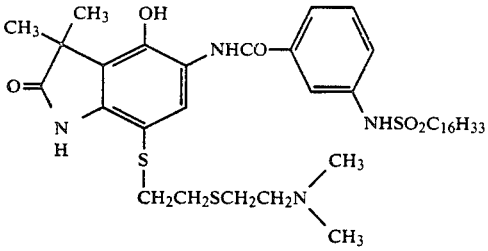

-continued
(B-25)
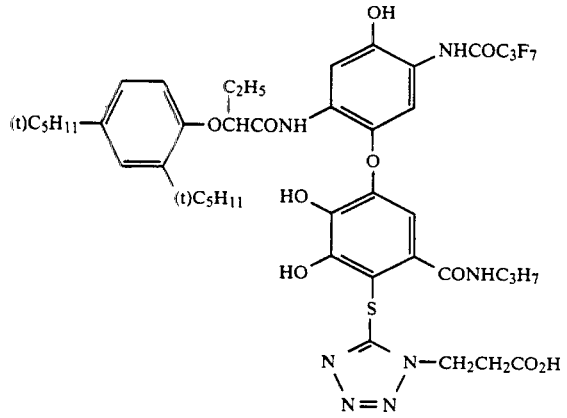
(B-26)
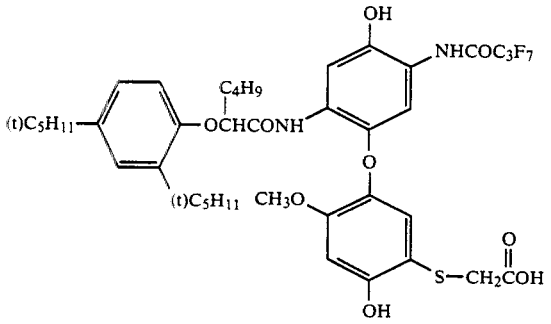
(B-27)
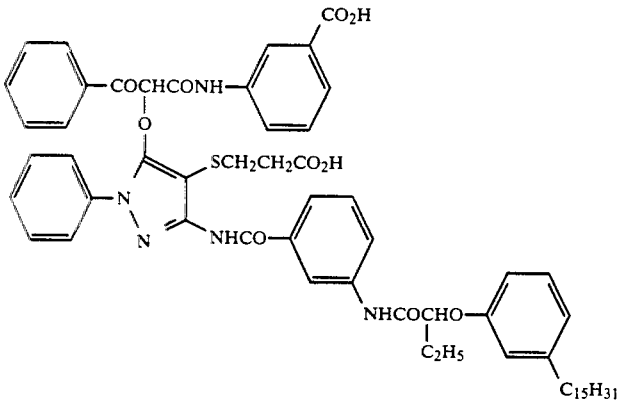
(B-28)
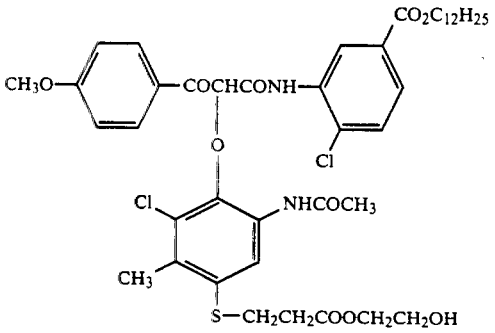

-continued
(B-29)
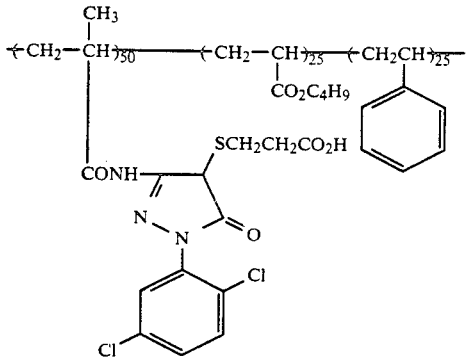
(B-30)
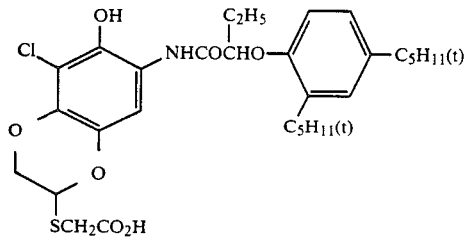
(B-31)
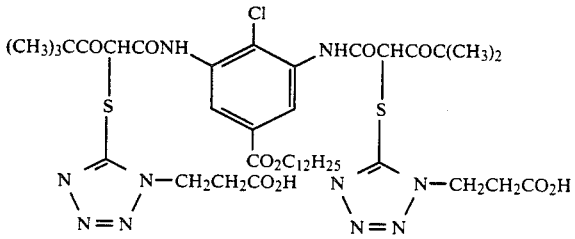
(B-32)
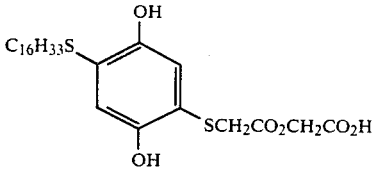
(B-33)
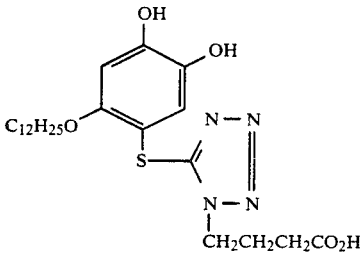
(B-34)
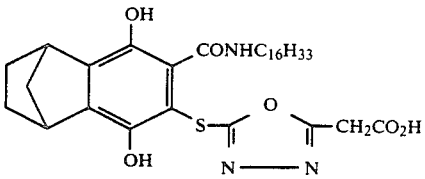

-continued
(B-35)
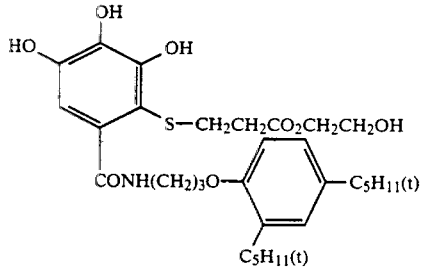
(B-36)
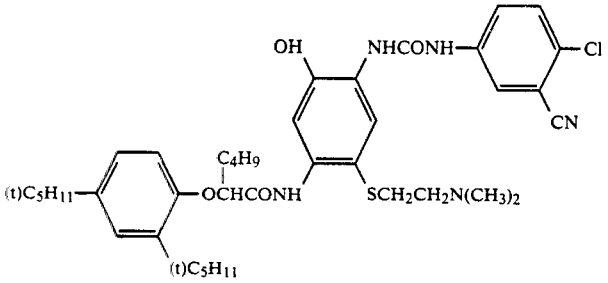
(B-37)
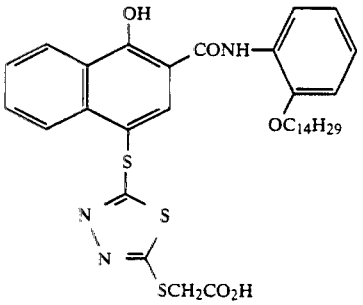
(B-38)
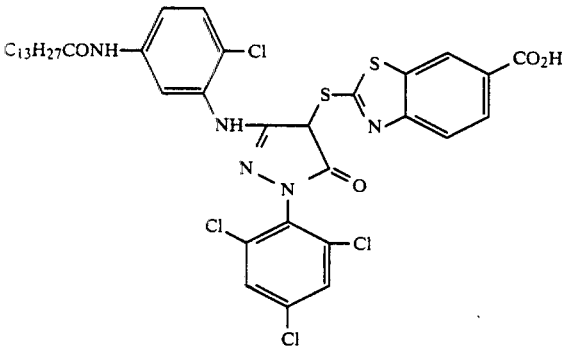
(B-39)
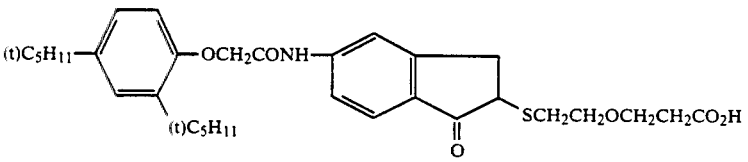

-continued
(B-40)
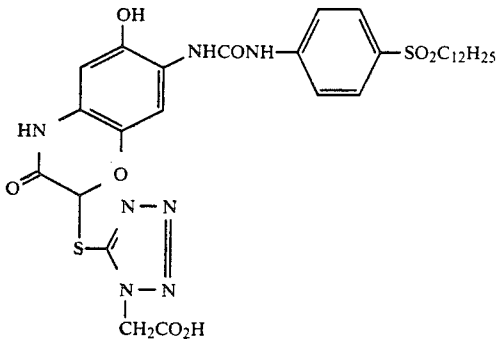
(B-41)
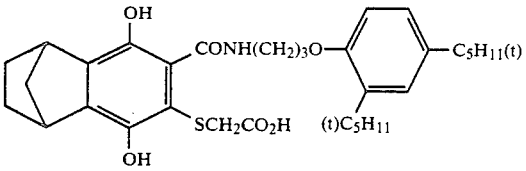
(B-42)
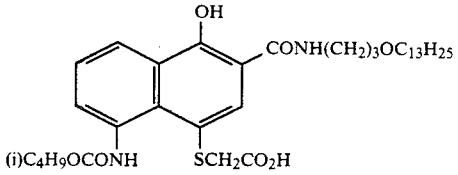
(B-43)
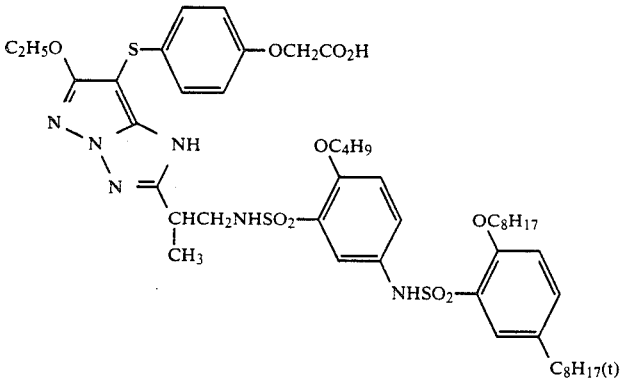
(B-44)
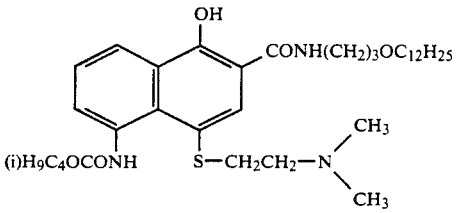
(B-45)
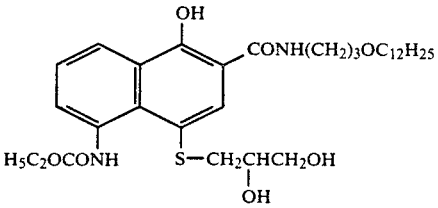

-continued (B-46)

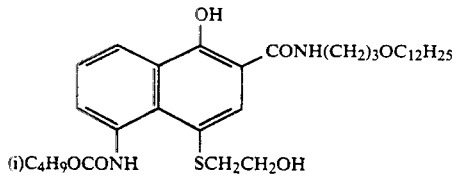

(B-47)

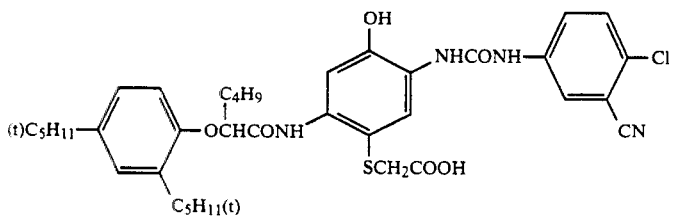

(B-48)

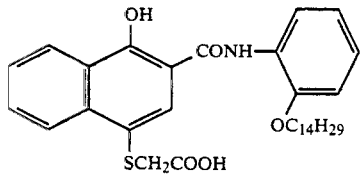

(B-49)

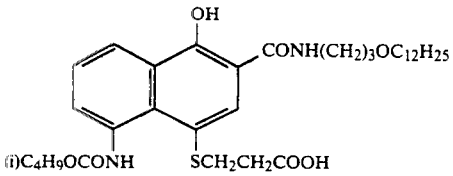

The other compounds disclosed in *Research Disclosure*, Item Nos. 24241 and 11449, JP-A-61-201247 (corresponding to EP-A-193389) and JP-A-63-106749, JP-A-63-121843 and JP-A-63-121844 can also be used in the same way.

Furthermore, the bleach accelerator releasing compounds used in this invention can be prepared easily on the basis of the disclosures in the above-mentioned patent specifications.

The amount of bleach accelerator releasing compound added to the photosensitive material in this invention is preferably from $1\times10^{-7}$ to $1\times10^{-1}$ mol, and most desirably from $1\times10^{-6}$ to $5\times10^{-2}$ mol, per square meter of photosensitive material. The bleach accelerator releasing compound can be added to all the layers of the photosensitive material, but it is preferably added to photosensitive emulsion layer(s), and the effect is especially pronounced when it is added to more than one photosensitive emulsion layers.

Various known compounds can be used as gelatin hardening agents in this invention.

For example, known compounds include aldehyde based compounds such as formaldehyde and glutaraldehyde, compounds which have reactive halogen disclosed in U.S. Pat. No. 3,288,775 and others, compounds which have ethylenically unsaturated bonds disclosed in U.S. Pat. No. 3,642,486, JP-B-49-13563 and others, aziridine-based compounds disclosed in U.S. Pat. No. 3,017,280, epoxy-based compounds disclosed in U.S. Pat. No. 3,091,537, halocarboxyaldehydes such as mucochloric acid, dioxanes, such as dihydroxydioxane and dichlorodioxane, and inorganic film hardening agents such as chrome alum and zirconium sulfate.

Furthermore, known hardening agents with which the hardening reaction with gelatin is comparatively rapid and with which post film hardening is slight include the compounds which have a dihydroquinoline skeleton disclosed in JP-A-50-38540, the compounds which have phosphorus-halogen bonds disclosed in JP-A-58-11,3929, the compounds which have N-sulfonyloxyimido groups disclosed in JP-A-52-93470, the compounds which contain two or more N-acyloxyimino groups in the molecule disclosed in JP-B-53-22089, the N-carbamoylpyridinium salts disclosed in JP-A-49-51945 and JP-A-51-59625, and the 2-sulfonyloxypyridinium salts disclosed in JP-A-56-110762.

These may be added beforehand to the coating liquids or they may be mixed with the coating liquids immediately prior to coating.

The use of those of the above-mentioned film hardening agents which can be represented by general formula (H) indicated below is preferred in this invention.

$$X^1—SO_2—L—SO_2—X^2 \quad (H)$$

In general formula (H), $X^1$ and $X^2$ are either $—CH{=}CH_2$ or $—CH_2CH_2Y$ groups, and they may be the same or different, where Y represents a group which can be substituted by nucleophilic groups or eliminated in the form of HY by means of a base (for example, halogen atom, sulfonyloxy, sulfate monoester, etc.), L is a divalent linking group, and it may have substituent groups.

The amount of film hardening agent added in this invention is within the range of from 0.01 to 20 wt %, and preferably within the range of from 0.1 to 10 wt %, with respect to the dry gelatin.

Specific example of $X^1$ and $X^2$ are indicated below.

$-CH{=}CH_2$ (X-1)
$-CH_2CH_2Cl$ (X-2)
$-CH_2CH_2Br$ (X-3)
$-CH_2CH_2OSO_2CH_3$ (X-4)

(X-5)

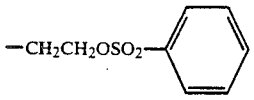

(X-6)

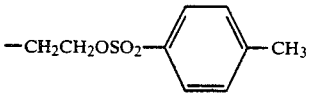

$-CH_2CH_2OSO_3Na$ (X-7)
$-CH_2CH_2OSO_3K$ (X-8)
$-CH_2CH_2OCOCH_3$ (X-9)
$-CH_2CH_2OCOCF_3$ (X-10)
$-CH_2CH_2OCOCHCl_2$ (X-11)
$-CH_2CH_2N^{\oplus}(C_2H_5)_3Cl^{\ominus}$ (X-12)

Of these groups, (X-1), (X-2), (X-3), (X-4), (X-7), and (X-12) are preferred, and (X-1) is especially desirable.

The divalent linking group L is an alkylene group or an arylene group, or a divalent group formed by combining these groups with one or more of the groups indicated by $-O-$, $-\underset{\underset{R^1}{|}}{N}-$, $-CO-$, $-SO-$, $-SO_2-$, $-SO_3-$, $-SO_2\underset{\underset{R^1}{|}}{N}-$, $-COO-$, $-CON\underset{\underset{R^1}{|}}{-}$, $-\underset{\underset{R^1}{|}}{N}-CO-\underset{\underset{R^1}{|}}{N}-$, and $-\underset{\underset{R^1}{|}}{N}CO_2-$.

$R^1$ represents a hydrogen atom, or an alkyl group or aralkyl group which has from 1 to 15 carbon atoms. Furthermore, when two or more of the groups $-O-$, $-\underset{\underset{R^1}{|}}{N}-$, $-SO_2\underset{\underset{R^1}{|}}{N}-$, $-CON\underset{\underset{R^1}{|}}{-}$, and $-\underset{\underset{R^1}{|}}{N}CO_2-$ are included, the $R^1$ groups may be bonded together to form a ring. Moreover, L may have substituent groups, and examples of such substituent groups include hydroxyl groups, alkoxy groups, carbamoyl groups, sulfamoyl groups, alkyl groups, aryl groups, and amino groups.

These substituent groups may be further substituted, and one or more groups which can be represented by $X_3-SO_2-$ may be included in the chemical structure. Here, $X^3$ has the same significance as $X^2$ described earlier.

Typical examples of L include those groups indicated below.

$\leftarrow CH_2 \rightarrow_a$ (L-1)

$\leftarrow CH_2 \rightarrow_b O \leftarrow CH_2 \rightarrow_c$ (L-2)

-continued $\leftarrow CH_2 \rightarrow_d CON(R^1) \leftarrow CH_2 \rightarrow_e N(R^2)CO \leftarrow CH_2 \rightarrow_f$ (L-3)

$\leftarrow CH_2 \rightarrow_g N(R^3) \leftarrow CH_2 \rightarrow_h$ (L-4)

$\leftarrow CH_2 \rightarrow_i CON(R^4) \leftarrow CH_2 \rightarrow_j O \leftarrow CH_2 \rightarrow_k N(R^5)CO \leftarrow CH_2 \rightarrow_l$ (L-5)

$\leftarrow CH_2 \rightarrow_m COO \leftarrow CH_2 \rightarrow_n OCO \leftarrow CH_2 \rightarrow_p$ (L-6)

$\leftarrow CH_2 \rightarrow_q SO_2 \leftarrow CH_2 \rightarrow_r$ (L-7)

In these formulas, a to d and f to r are integers having a value of from 1 to 6, and e has a value of from 0 to 6. In these formulas, a, e, j, k, and n preferably have a value of from 1 to 3, and b, c, d, f, g, h, i, l, m, p, q, and r preferably have a value of 1 or 2. $R^1$ to $R^5$ are hydrogen atoms, or substituted or unsubstituted alkyl groups which have from 1 to 6 carbon atoms, and $R^1$ and $R^2$, and $R^4$ and $R^5$, may be joined together to form rings. $R^1$ to $R^6$ are preferably hydrogen atoms, methyl groups or ethyl groups. Furthermore, these L groups may have substituent groups.

Typical examples of cases in which L has substituent groups, and of cases in which the aforementioned groups $R^1$ and $R^2$ are bonded, are indicated below.

(L-8)

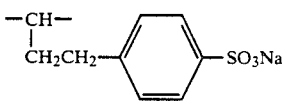

(L-9)

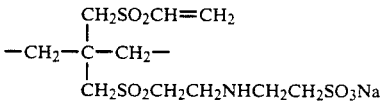

(L-10)

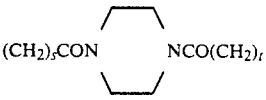

(L-11)

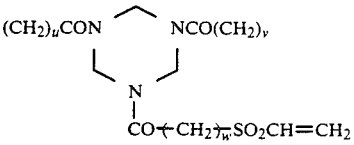

In these formulas, s to w each represents an integer having a value of 1 or 2.

Of these L groups, (L-1), (L-2), (L-3), (L-8), and (L-9) are preferred, and (L-1) and (L-9) are especially desirable.

The use of the hardening agents indicated below is preferred. These are specific examples of hardening agents, but the invention is not limited to these agents.

$CH_2{=}CHSO_2CH_2SO_2CH{=}CH_2$ (H-1)
$CH_2{=}CHSO_2CH_2CH_2CH_2SO_2CH{=}CH_2$ (H-2)

(H-3)

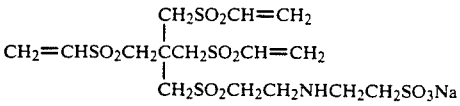

-continued $CH_2{=}CHSO_2CH_2OCH_2SO_2CH{=}CH_2$ (H-4)

$CH_2{=}CHSO_2CH_2CH_2OCH_2CH_2SO_2CH{=}CH_2$ (H-5)

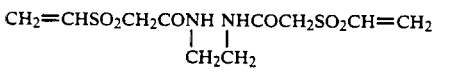
(H-6)

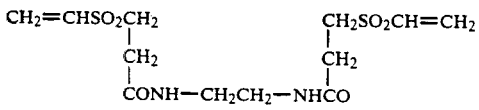
(H-7)

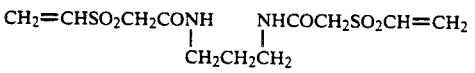
(H-8)

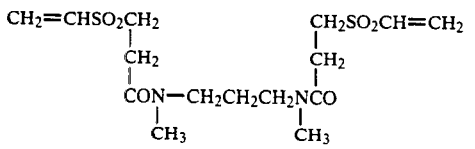
(H-9)

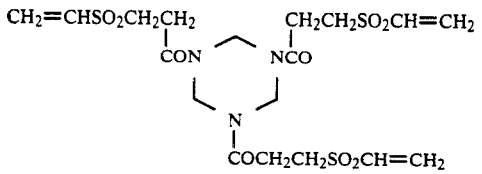
(H-10)

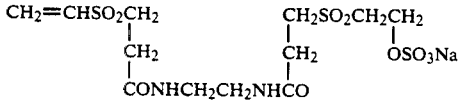
(H-11)

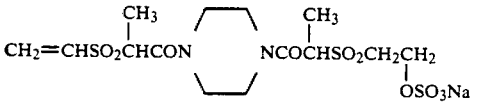
(H-12)

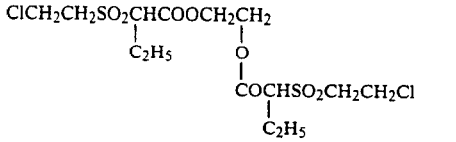
(H-13)

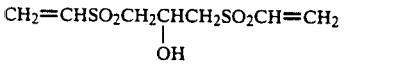
(H-14)

Methods for the preparation of hardening agents which can be used in the invention are described in detail, for example, in JP-B-47-2429, JP-B-50-35807, JP-A-49-24435, JP-A-53-41221 and JP-A-59-18944.

Provided that at least a blue-sensitive silver halide emulsion layer, a green-sensitive silver halide emulsion layer and a red-sensitive silver halide emulsion layer are provided on a support, there is no particular limitation on the number and type of silver halide emulsion layers and non-photosensitive layers in the photosensitive materials of this invention. Typical examples include silver halide photographic materials which have at least one photosensitive layer consisting of a plurality of silver halide emulsion layers which have essentially the same color sensitivity but different speeds on a support, and the photosensitive layer is a unit photosensitive layer which is photosensitive to any of blue light, green light and red light, and in a multilayer silver halide photographic material the arrangement of the unit photosensitive layers is generally such that the layers are arranged, from the support side, in the order red-, green-, and blue-sensitive layers. However, the order in which the layers are provided can be changed so as to reduce the thickness of the different layers among the layers of the same color sensitivity, even if the order indicated above is reversed, according to the intended purpose.

Various non-photosensitive layers, such as intermediate layers, can be provided between the silver halide photosensitive layers mentioned above, and as uppermost layers and lowermost layers.

Couplers, DIR compounds, etc., such as those disclosed in the specifications of JP-A-61-43748, JP-A-59-113438, JP-A-59-113440, JP-A-61-20037 and JP-A-61-20038, can be included in the intermediate layers, and they may also contain color mixing preventing agents which are normally used.

The plurality of silver halide emulsion layers which constitute each unit photosensitive layer preferably have a two-layer structure consisting of a high speed emulsion layer and a low speed emulsion layer as described in West German Patent 1,121,470 or British Patent 923,045. Normally, an arrangement in which the layers are arranged in such a way that the photo-sensitivity falls towards the support is preferred, and a non-photosensitive layer may be provided between each silver halide emulsion layer. Furthermore, the arrangement may be such that the low speed emulsion layer is provided on the side away from the support and the high speed emulsion layer is arranged on the side closer to the support, as described in JP-A-57-112751, JP-A-62-200350, JP-A-62-206541 and JP-A-62-206543.

As specific examples, the layers can be arranged in the order, from the side furthest away from the support, low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), or in the order BH/BL/GL/GH/RH/RL, or in the order BH/BL/GH/GL/RL/RH.

The layers can also be arranged in the order blue-sensitive layer/GH/RH/GL/RL from the side furthest away from the support as disclosed in JP-B-55-34932. Furthermore, the layers can be arranged in the order blue-sensitive layer/GL/RL/GH/RH from the side furthest from the support, as described in the specifications of JP-A-56-25738 and JP-A-62-63936.

Furthermore, there are arrangements in which the uppermost layer is the silver halide emulsion layer which has the highest photosensitivity, the middle layer is a silver halide emulsion layer which has a lower photosensitivity, and the lowermost layer is a silver halide emulsion layer which has a photosensitivity lower than that of the middle layer, as described in JP-B-49-15495, this arrangement consisting of three layers of different photosensitivities arranged in such a way that the photosensitivity falls sequentially towards the support. Structures consisting of three layers of different photosensitivities of this type can also be arranged in the order, from the side furthest away from the support intermediate speed emulsion layer/high speed emulsion layer/low speed emulsion layer in the same color sensitive layer, as described in the specification of JP-A-59-202464.

Various layer structures and arrangements can be selected in accordance with the intended purpose of the photosensitive material, as described above.

The silver halides preferably included in the photographic emulsion layers of the photographic materials in which the invention is used are silver iodobromides, silver iodochlorides, and silver iodochlorobromides which contain not more than about 30 mol % of silver iodide. Most desirably the silver halide is a silver iodobromide or silver iodochlorobromide which contains from about 2 mol % to about 25 mol % of silver iodide.

The silver halide grains in the photographic emulsions may have a regular crystalline form, such as a cubic, octahedral or tetradecahedral form, or an irregular crystalline form, such as a spherical or a tabular form, or they may have crystal defects such as twin planes, or they may have a composite form consisting of these forms.

The grain size of the silver halide may be from fine grains of not more than about 0.2 μm to large grains of which the diameter of the projected area is about 10 μm, and the emulsions may be polydisperse emulsions or monodisperse emulsions.

The silver halide photographic emulsions which can be used in the invention can be prepared using the methods described, for example, in *Research Disclosure* (*RD*), Item No. 17643 (December, 1978), pages 22 and 23 "I. Emulsion Preparation and Types", *Research Disclosure*, Item No. 18716 (November, 1979), page 648; *Chemie et Physique Photographique*, by P. Glafkides, published by Paul Montel, 1967; *Photographic Emulsion Chemistry*, by G. F. Duffin, published by Focal Press, 1966; and *Making and Coating Photographic Emulsions*, by V. L. Zelikman et al., published by Focal Press, 1964.

The monodisperse emulsions disclosed, for example, in U.S. Pat. Nos. 3,574,628 and 3,655,394, and British Patent 1,413,748 are preferred.

Furthermore, tabular grains which have an aspect ratio of at least about 5 can be used in this invention. Tabular grains can be prepared easily using the methods described, for example, by Gutoff in *Photographic Science and Engineering*, Vol. 14, pp. 248 to 257 (1970), U S. Pat. Nos. 4,434,226, 4,414,310, 4,433,048 and 4,439,520, and British Patent 2,112,157.

The crystal structure may be uniform, the inner and outer parts may have a heterogeneous halogen composition, or they may have a layered structure and, moreover, silver halides which have different compositions may be joined with an epitaxial junction or they may be joined to compounds other than silver halides, such as silver thiocyanate or lead oxide, for example.

Mixtures of grains of various crystalline forms may also be used.

The silver halide emulsions used have normally been subjected to physical ripening, chemical ripening and spectral sensitization. Additives used in such processes are disclosed in *Research Disclosure*, Item Nos. 17643 and 18716 and the locations of these items are summarized in the table below.

Known Photographically useful additives which can be used in this invention are also disclosed in the two *Research Disclosures* mentioned above, and the locations of these disclosures are also shown in the table below.

| Type of Additive | RD 17643 | RD 18716 |
|---|---|---|
| 1. Chemical Sensitizers | Page 23 | Page 648, right column |

-continued

| Type of Additive | RD 17643 | RD 18716 |
|---|---|---|
| 2. Speed Increasing Agents | | Page 648, right column |
| 3. Spectral Sensitizers, Supersensitizers | Pages 23-24 | Pages 648, right column to 649, right column |
| 4. Whitening Agents | Page 24 | |
| 5. Antifoggants and Stabilizers | Pages 24-25 | Page 649, right column |
| 6. Light Absorbers, Filter Dyes, UV Absorbers | Pages 25-26 | Pages 649, right column to 650, left column |
| 7. Antistaining Agents | Page 25, right column | Page 650, left to right columns |
| 8. Dye Image Stabilizers | Page 25 | |
| 9. Hardening Agents | Page 26 | Page 651, left column |
| 10. Binders | Page 26 | Page 651, left column |
| 11. Plasticizers, Lubricants | Page 27 | Page 650, right column |
| 12. Coating Assistants, Surfactants | Pages 26-27 | Page 650, right column |
| 13. Antistatic Agents | Page 27 | Page 650, right column |

Furthermore, the compounds which react with and fix formaldehyde, disclosed in U.S. Pat. Nos. 4,411,987 and 4,435,503 are preferably added to the photosensitive material in order to prevent any deterioration of photographic performance due to formaldehyde gas.

Various color couplers can be used in this invention, and specific examples have been disclosed in the patents disclosed in the aforementioned *Research Disclosure* (*RD*), Item No. 17643, sections VII C to G.

Those disclosed, for example, in U.S. Pat. Nos. 3,933,501, 4,022,620, 4,326,024 and 4,401,752, JP-B-58-10739, British Patents 1,425,020 and 1,476,760, U.S. Pat. Nos. 3,973,968, 4,314,023 and 4,511,649, and European Patent 249,473A are preferred as yellow couplers.

The 5-pyrazolone- and pyrazoloazole-based compounds are preferred as magenta couplers, and those disclosed, for example, in U.S. Pat. Nos. 4,310,619 and 4,351,897, European Patent 73,636, U.S. Pat. Nos. 3,061,432 and 3,725,064, *Research Disclosure*, Item No. 2422 (June, 1984), JP-A-60-33552, *Research Disclosure*, Item No. 24230 (June, 1984), JP-A-60-43659, JP-A-61-72238, JP-A-60-35730, JP-A-55-118034, JP-A-60-185951 and U.S. Pat. Nos. 4,500,630, 4,540,654 and 4,556,630 are especially desirable.

Phenol- and naphthol-based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (Laid Open) 3,329,729, European Patents 121,365A and 249,453A, U.S. Pat. Nos. 3,446,622, 4,333,999, 4,451,559, 4,427,767, 4,690,889, 4,254,212, and 4,296,199 and JP-A-61-42658 are preferred.

The colored couplers for correcting the unwanted absorptions of the colored dyes disclosed, for example, in *Research Disclosure*, Item No. 17643, section VII-G, U.S. Pat. No. 4,163,670, JP-B-57-39413, U.S. Pat. Nos. 4,004,929 and 4,138,258, and British Patent 1,146,368 are preferred.

The couplers of which the colored dyes have a suitable degree of diffusibility disclosed in U.S. Pat. No. 4,366,237, British Patent 2,125,570, European Patent 96,570 and West German Patent (Laid Open) 3,234,533 are preferred.

Typical examples of polymerized dye-forming couplers are disclosed, for example, in U.S. Pat. Nos. 3,451,820, 4,080,211, 4,367,282, 4,409,320 and 4,576,910, and British Patent 2,102,173.

The use of couplers which release residual groups which are useful photographically on coupling is preferred in this invention. The DIR couplers which release development inhibitors disclosed in the patents disclosed in the aforementioned *Research Disclosure*, Item No. 17643, section VII-F, JP-A-57-151944, JP-A-57-154234, JP-A-60-184248, and U.S. Pat. No. 4,248,962 are preferred.

The couplers disclosed in British Patents 2,097,140 and 2,131,188, JP-A-59-157638 and JP-A-59-170840 are preferred as couplers which imagewise release nucleating agents or development accelerators during development.

Other couplers which can be used in the photosensitive materials of this invention include the competitive couplers disclosed, for example, in U.S. Pat. No. 4,130,427, the poly-equivalent couplers disclosed in U.S. Pat. Nos. 4,283,472, 4,338,393 and 4,310,618, etc., the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release a dye to which color is restored after elimination, as disclosed in European Patent 173,302A, and the ligand releasing couplers disclosed, for example, in U.S. Pat. No. 4,553,477.

The couplers which are used in the invention can be introduced into the photosensitive materials using the various known methods of dispersion.

Examples of high boiling point solvents which can be used in the oil-in-water dispersion methods are disclosed, for example, in U.S. Pat. No. 2,322,027.

Specific examples of high boiling point organic solvents of boiling point above 175° C. at normal pressure which can be used in the oil-in-water dispersion method include phthalate esters (for example, dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate, bis(1,1-diethylpropyl)phthalate, etc.), esters of phosphoric acid or phosphonic acid (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide, N-tetradecylpyrrolidone), alcohols or phenols (for example, isostearyl alcohol, 2,4-di-tert-amylphenol), aliphatic carboxylic acid esters (for example, bis(2-ethylhexyl) sebacate, dioctyl azelate, glycerol tributyrate, isostearyl lactate, trioctyl citrate), aniline derivatives (for example, N,N-dibutyl-2-butoxy-5-tertoctylaniline), and hydrocarbons (for example, paraffins, dodecylbenzene, diisopropylnaphthalene). Organic solvents having a boiling point of about 30° C. or higher, and preferably of 50° C. or higher, but about 160° C. or lower, can be used as auxiliary solvents, and typical examples of such solvents include ethyl acetate, butyl acetate, ethyl propionate, methyl ethyl ketone, cyclohexanone, 2-ethoxyethyl acetate and dimethylformamide.

The processes and effects of the latex dispersion method, and specific examples of latexes for loading, are disclosed, for example, in U.S. Pat. No. 4,199,363, and West German Patent Applications (OLS) 2,541,274 and 2,541,230.

The invention can be applied to various types of color photosensitive materials. Typical examples include color negative films for general and cinematographic purposes, color reversal films for slide and television purposes, color papers, color positive films and color reversal papers, etc.

Suitable supports which can be used in the invention are disclosed, for example, on page 28 of the aforementioned *Research Disclosure*, Item No. 17643, and from the right hand column on page 647 to the left hand column on page 648 of the aforementioned *Research Disclosure*, Item No. 18716.

The color photographic materials of this invention can be developed and processed using the conventional methods disclosed on pages 28 and 29 of the aforementioned *Research Disclosure*, Item No. 17643 and in the left and right hand columns of page 651 of the aforementioned *Research Disclosure*, Item No. 18716.

The color development baths used in the development processing of the photosensitive materials of this invention are preferably aqueous alkaline solutions which contain primary aromatic amine-based color developing agents as the principal components. Aminophenol-based compounds are useful as color developing agents, but the use of p-phenylenediamine-based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, depending on the intended purpose.

The color development baths generally contain pH buffers, such as alkali metal carbonates, borates or phosphates, and development inhibitors or antifogging agents, such as bromides, iodides, benzimidazoles, benzothiazoles or mercapto compounds, etc. They may also contain, as required, various preservatives, such as hydroxylamine, diethylhydroxylamine, sulfites, hydrazines, phenylsemicarbazides, triethanolamine, catechol sulfonic acids, triethylenediamine(1,4-diazabicyclo[2,2,2]octane), etc., organic solvents such as ethylene glycol and diethylene glycol, development accelerators such as benzyl alcohol, poly(ethylene glycol), quaternary ammonium salts and amines, dye-forming couplers, competitive couplers, fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these compounds.

Color development is carried out after a normal black-and-white development in the case of reversal processing. The known black-and-white developing agents, for example, dihydroxybenzenes such as hydroquinone, 3-pyrazolidones such as 1-phenyl-3-pyrazolidone, and aminophenols such as N-methyl-p-aminophenol, can be used individually, or in combinations, as the black-and-white developing agent.

The pH of these color developers and black-and-white developers is generally within the range of from 9 to 12. Furthermore, the replenishment rate of the development bath depends on the color photographic material which is being processed, but it is generally less than 3 liters per square meter of the photosensitive material, and, by reducing the bromide ion concentration in the replenisher, it is possible to use a replenishment rate of less than 500 ml per square meter of the photo-sensitive material. The prevention of loss of liquid by evaporation, and air oxidation, by minimizing the contact area with the air in the processing tank is desirable in cases where the replenishment rate is low. Furthermore, the replenishment rate can be reduced by using a means of suppressing the accumulation of bromide ion in the developer.

The color development processing time is normally set between 2 and 5 minutes, but it is possible to shorten the processing time by using higher temperatures, higher pH level and higher concentrations of the color developing agent.

The photographic emulsion layers are normally subjected to a bleaching process after color development. The bleaching process may be carried out at the same time as the fixing process (in a bleach-fix process) or it may be carried out as a separate process. Moreover, a bleach-fix process can be carried out after a bleaching process in order to speed up the processing. Moreover, the processing can be carried out in two connected bleach-fix baths, a fixing process can be carried out before carrying out a bleach-fix process, or a bleaching process can be carried out after a bleach-fix process, according to the intended purpose of the processing. Compounds of a multivalent metal such as iron(III), cobalt(III), chromium(VI), copper(II), etc., peracids, quinones, nitro compounds, etc., can be used as bleaching agents. Typical bleaching agents include ferricyanides; dichromates; organic complex salts of iron(III) or cobalt(III), for example, complex salts with aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, etc., or citric acid, tartaric acid, malic acid, etc.; persulfates; bromates; permanganates and nitrobenzenes, etc. Of these materials, the use of the aminopolycarboxylic acid iron(III) complex salts including ethylenediaminetetraacetic acid iron(III) complex salts, and persulfates, is preferred from the points of view of both rapid processing and the prevention of environmental pollution. Moreover, the aminopolycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but processing can be speeded up by using a lower pH.

Bleach accelerators can be used, as required, in the bleach baths, bleach-fix baths, or bleach or bleach-fix prebaths. Specific examples of useful bleach accelerators are disclosed in the following specifications: Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, Item No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ions, etc. Among these compounds, those which have a mercapto group or a disulfide group are preferred in view of their high accelerating effect, and the use of the compounds disclosed in U.S. Pat. No. 3,893,858, West German Patent 1,290,812 and JP-A-53-95630 is desirable. Moreover, the use of the compounds disclosed in U.S. Pat. No. 4,552,834 is also desirable. These bleach accelerators may be added to the photosensitive material. These bleach accelerators are especially effective when bleach-fixing camera color photosensitive materials.

Thiosulfates, thiocyanates, thioether-based compounds, thioureas and large quantities of iodides, etc., can be used as fixing agents, but thiosulfates are generally used for this purpose, and ammonium thiosulfate in particular can be used in the widest range of applications. Sulfites or bisulfites, or carbonyl-bisulfite addition compounds, are the preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example, the materials, such as couplers, which are being used), the wash water temperature, the number of washing tanks (the number of washing stages), the replenishment system, i.e., whether a counter-flow or a sequential-flow system is used, and various other conditions. The relationship between the amount of water used and the number of water washing tanks in a multistage counter-flow system can be obtained using the method outlined on pages 248 to 253 of *Journal of the Society of Motion Picture and Television Engineers*, Vol. 64 (May, 1955).

The amount of wash water can be greatly reduced by using the multistage counter-flow system noted in the aforementioned literature, but bacteria proliferate due to the increased residence time of the water in the tanks and problems arise as a result of the attachment of suspended matters to the photosensitive material. The method in which the calcium ion and manganese ion concentrations are reduced as disclosed in JP-A-62-288838 can be used very effectively to overcome the problems of this sort in the processing of the color photosensitive materials of this invention. Furthermore, the isothiazolone compounds and thiabendazoles disclosed in JP-A-57-8542, and chlorine-based disinfectants such as chlorinated sodium isocyanurate, and benzotriazoles, etc., and the disinfectants disclosed in *Chemistry of Biocides and Fungicides* (1982) by Horiguchi, *The Killing of Microorganisms, Biocidal and Fungicidal Techniques*

(1982), published by the Health and Hygiene Technical Society and in *A Dictionary of Biocides and Fungicides* (1986), published by the Japanese Biocide and Fungicide Society, can be used for this purpose.

The pH value of the wash water used in the processing of the photosensitive materials of the invention is normally within the range of from 4 to 9, and preferably within the range of from 5 to 8. The wash water temperature and the washing time can be set variously according to the nature of the photosensitive material and the application, etc., but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the aforementioned water washing process, and the stabilizing baths which contain formalin and surfactant which are used as a final bath for camera color photosensitive materials are an example of such a process. Various chelating agents and fungicides, etc., can be added to these stabilizing baths.

The overflow which accompanies replenishment of the above-mentioned wash water and/or stabilizer can be reused in other processes such as the desilvering process.

A color developing agent may also be incorporated into the silver halide color photosensitive materials of this invention in order to simplify and speed up the processing. The incorporation of various color developing agent precursors is preferred. For example, the indoaniline-based compounds disclosed in U.S. Pat. No. 3,342,597, the Schiff's base type compounds disclosed in U.S. Pat. No. 3,342,597 and *Research Disclosure*, Item Nos. 14850 and 15159, the aldol compounds disclosed in *Research Disclosure*, Item No. 13924, the metal salt complexes disclosed in U.S. Pat. No. 3,719,492, and the urethane-based compounds disclosed in JP-A-53-135628 can be used for this purpose.

Various 1-phenyl-3-pyrazolidones can be incorporated, as required, into the silver halide color photosensitive materials of this invention for accelerating color development. Typical compounds of this type are disclosed, for example, in JP-A-56-64339, JP-A-57-144547 and JP-A-58-115438.

The various processing baths in this invention are used at a temperature of from 10° C. to 50° C. The standard temperature is normally from 33° C. to 38° C., but the processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize on silver in the photosensitive material.

Furthermore, the silver halide photosensitive materials of this invention can also be used as heat developable photosensitive materials as disclosed, for example, in U.S. Pat. No. 4,500,626, JP-A-60-133449, JP-A-59-218443, JP-A-61-238056, and European Patent 210,660A2.

EXAMPLE 1

Sample 101, a multilayer color photosensitive material consisting of various layers, of which the compositions are indicated below, on a cellulose triacetate film, on which an underlayer had been provided, was prepared.

Composition of the Photosensitive Layer

The coated weights are shown in units of grams of silver per square meter in the case of the silver halides and colloidal silver, in units of grams per square meter in the case of couplers, additives and gelatin, and as the number of mols per mol of silver halide in the same layer in the case of the sensitizing dyes.

| | |
|---|---|
| First Layer: Antihalation Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Intermediate Layer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low Speed Red-Sensitive Emulsion Layer | |
| Silver iodobromide emulsion (AgI: 4 mol %, uniform AgI type, diameter of the corresponding sphere: 0.3 μm, variation coefficient of the corresponding sphere diameter: 20%, tabular grains, diameter/thickness ratio: 3.0) | |
| Coated weight as silver | 1.2 |
| Silver iodobromide emulsion (AgI: 3 mol %, uniform AgI type, diameter of the corresponding sphere: 0.3 μm, variation coefficient of the corresponding sphere diameter: 15%, spherical grains, diameter/thickness ratio: 1.0) | |
| Coated weight as silver | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| ExC-8 | 0.03 |
| Fourth Layer: High Speed Red-Sensitive Emulsion Layer | |
| Silver iodobromide emulsion (AgI: 6 mol %, high internal AgI type of core/shell ratio: 1/1, diameter of the corresponding sphere: 0.7 μm, variation coefficient of the corresponding sphere diameter: 15%, tabular grains, diameter/thickness ratio: 5.0) | |
| Coated weight as silver | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-2 | 0.05 |
| Fifth Layer: Intermediate Layer | |
| Gelatin | 0.5 |
| Cpd-7 | 0.2 |
| Solv-1 | 0.05 |
| Sixth Layer: Low Speed Green-Sensitive | |

-continued

| Emulsion Layer | |
|---|---|
| Silver iodobromide emulsion (AgI: 4 mol %, high surface AgI type of core/shell ratio: 1/1, diameter of the corresponding sphere: 0.5 μm, variation coefficient of the corresponding sphere diameter: 15%, tabular grains, diameter/thickness ratio: 4.0) | |
| Coated weight as silver | 0.35 |
| Silver iodobromide emulsion (AgI: 3 mol %, uniform AgI type, diameter of the corresponding sphere: 0.3 μm, variation coefficient of the corresponding sphere diameter: 25%, spherical grains, diameter/thickness ratio: 1.0) | |
| Coated weight as silver | 0.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High Speed Green-Sensitive Emulsion Layer | |
| Silver iodobromide emulsion (AgI: 4 mol %, high internal AgI type of core/shell ratio: 1/3, diameter of the corresponding sphere: 0.7 μm, variation coefficient of the corresponding sphere diameter: 20%, tabular grains, diameter/thickness ratio: 5.0) | |
| Coated weight as silver | 0.8 |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.04 |
| Solv-1 | 0.2 |
| Solv-4 | 0.01 |
| Eighth Layer: Intermediate Layer | |
| Gelatin | 0.5 |
| Cpd-1 | 0.05 |
| Solv-1 | 0.02 |
| Ninth Layer: Donor Layer of Interlayer Effect for the Red-Sensitive Layer | |
| Silver iodobromide emulsion (AgI: 4 mol %, high internal AgI type of core/shell ratio: 2/1, diameter of the corresponding sphere: 1.0 μm, variation coefficient of the corresponding sphere diameter: 15%, tabular grains, diameter/thickness ratio: 6.0) | |
| Coated weight as silver | 0.35 |
| Silver iodobromide emulsion (AgI: 2 mol %, high internal AgI type of core/shell ratio: 1/1, diameter of the corresponding sphere: 0.4 μm, variation coefficient of the corresponding sphere diameter: 20%, tabular grains, diameter/thickness ratio: 6.0) | |
| Coated weight as silver | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |

-continued

| Tenth Layer: Yellow Filter Layer | |
|---|---|
| Yellow colloidal silver | 0.05 |
| Gelatin | 0.5 |
| Cpd-2 | 0.13 |
| Solv-1 | 0.13 |
| Cpd-1 | 0.10 |
| Eleventh Layer: Low Speed Blue-Sensitive Emulsion Layer | |
| Silver iodobromide emulsion (AgI: 4.5 mol %, uniform AgI type, diameter of the corresponding sphere: 0.7 μm, variation coefficient of the corresponding sphere diameter: 15%, tabular grains, diameter/thickness ratio: 7.0) | |
| Coated weight as silver | 0.3 |
| Silver iodobromide emulsion (AgI: 3 mol %, uniform AgI type, diameter of the corresponding sphere: 0.3 μm, variation coefficient of the corresponding sphere diameter: 25%, tabular grains, diameter/thickness ratio: 7.0) | |
| Coated weight as silver | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High Speed Blue-Sensitive Emulsion Layer | |
| Silver iodobromide emulsion (AgI: 10 mol %, high internal AgI type, diameter of the corresponding sphere: 1.0 μm, variation coefficient of the corresponding sphere diameter: 25%, multiple twin tabular grains, diameter/thickness ratio: 2.0) | |
| Coated weight as silver | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine grain silver bromide emulsion (AgI: 2 mol %, uniform AgI type, corresponding sphere diameter: 0.07 μm) | |
| Coated weight as silver | 0.5 |
| Gelatin | 0.45 |
| Poly(methyl methacrylate) particles (diameter: 1.5 μm) | 0.2 |
| H-7 | 0.45 |
| Cpd-5 | 0.5 |
| Cpd-6 | 0.5 |
| Cpd-8 | 0.2 |

Emulsion Stabilizer Cpd-3 (0.04 g/m$^2$) and Surfactant Cpd-4 (0.02 g/m$^2$) as coating assistant were added to each layer in addition to the components indicated above.

Film Hardening Agent H-7 was mixed with the coating liquid prior to coating so as to provide a Hardening Agent H-7/gelatin ratio of 5.0 wt %.

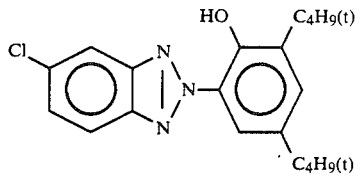

UV-1

-continued
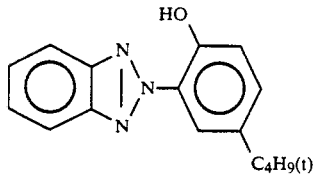
UV-2
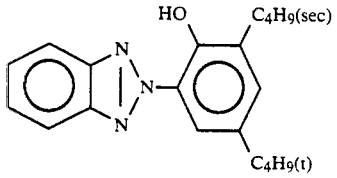
UV-3
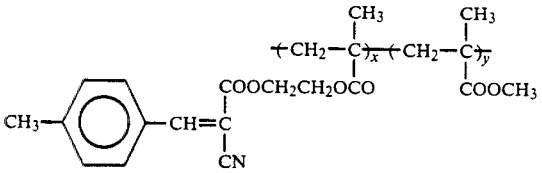
UV-4
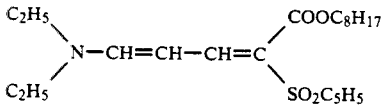
UV-5
x/y = 7/3 (by weight)
Tricresyl phosphate — Solv-1
Dibutyl phthalate — Solv-2
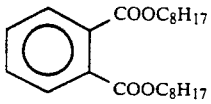
Solv-3
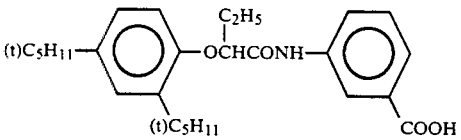
Solv-4
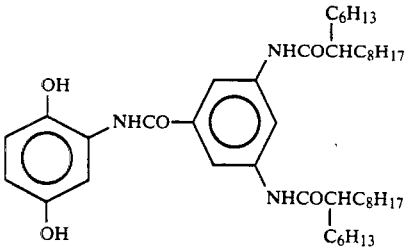
Cpd-1
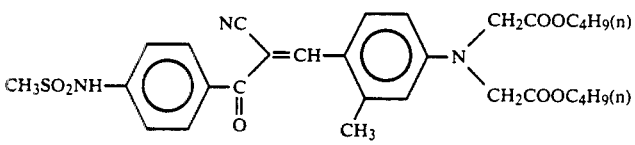
Cpd-2

-continued
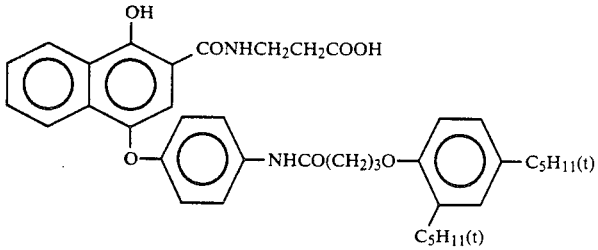
Cpd-7
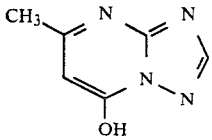
Cpd-3
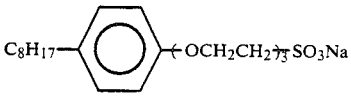
Cpd-4
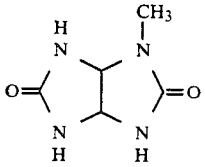
Cpd-5
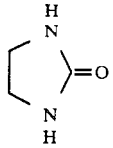
Cpd-6
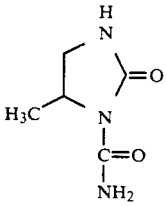
Cpd-8
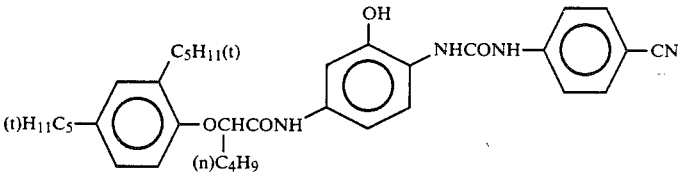
ExC-1
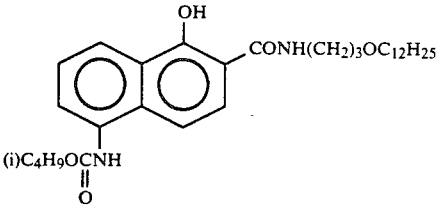
ExC-2

-continued
ExC-3
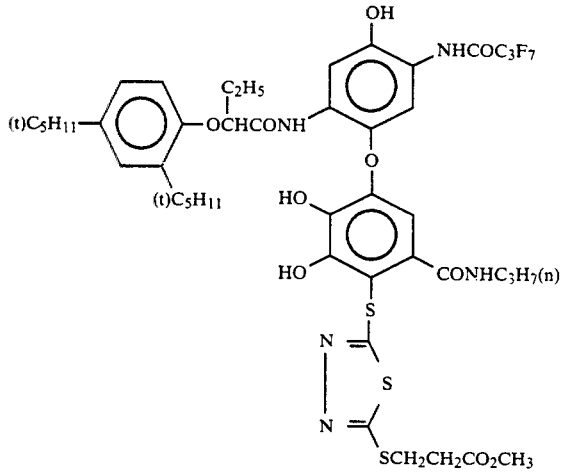
ExC-4
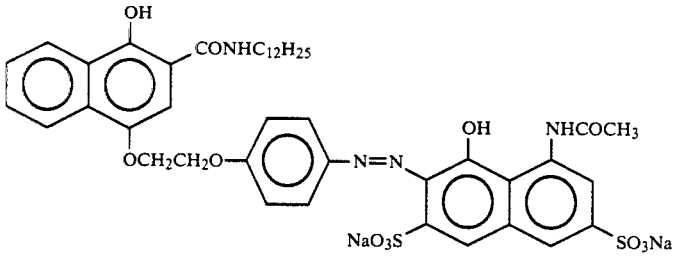
ExC-8
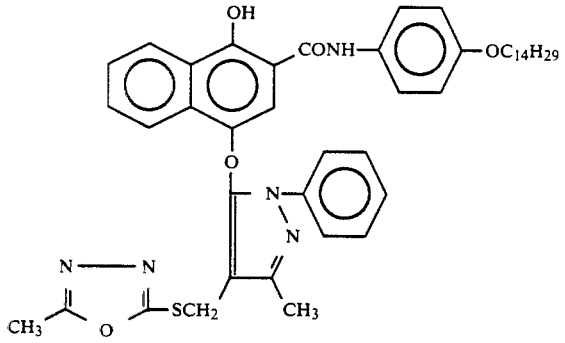
ExC-5
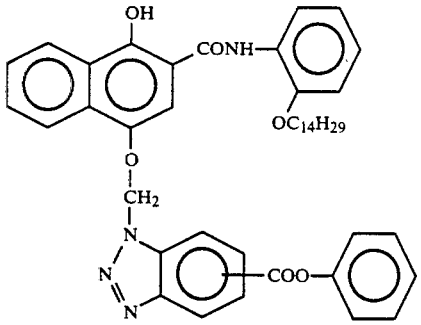

-continued
ExC-6
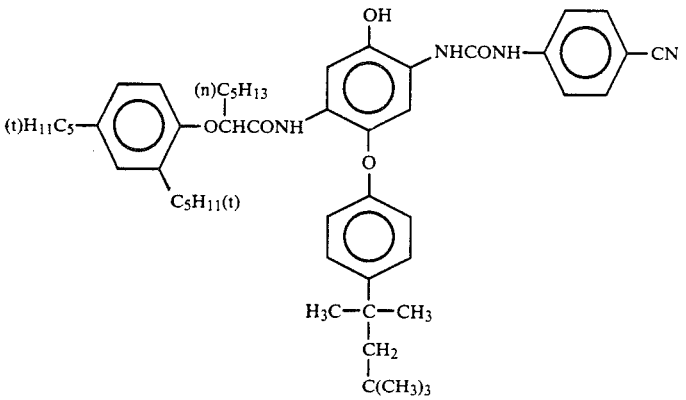
ExC-7
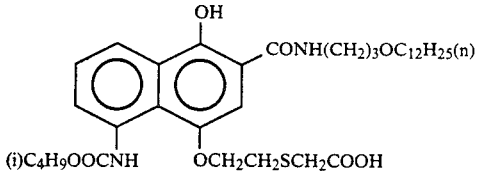
ExM-8
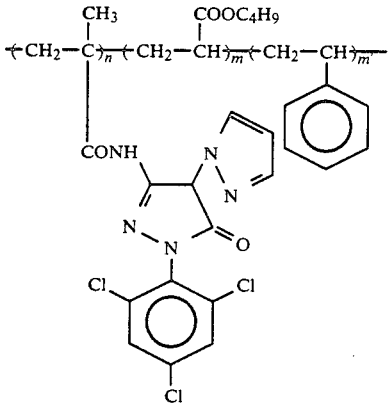
n = 50
m = 25
m' = 25
Mol. Wt. About 20,000
ExM-9
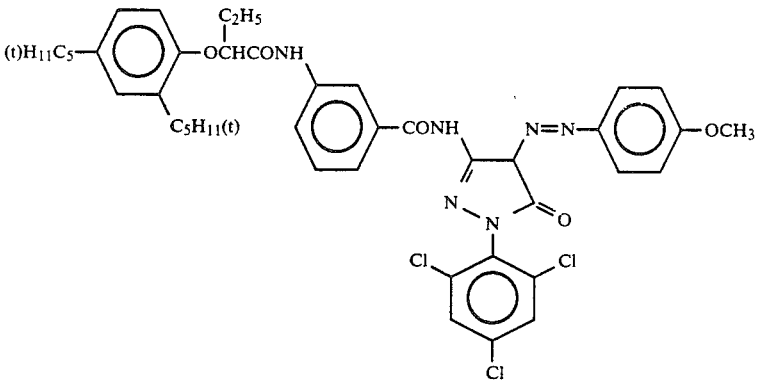

-continued
ExM-10
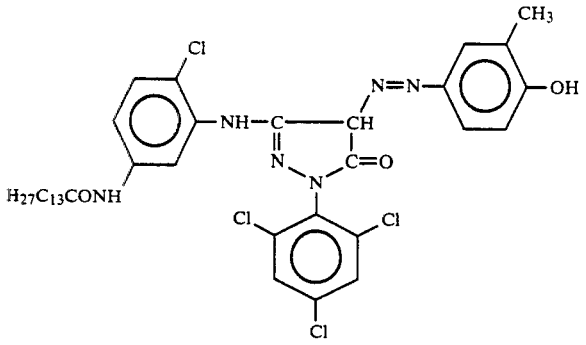
ExY-11
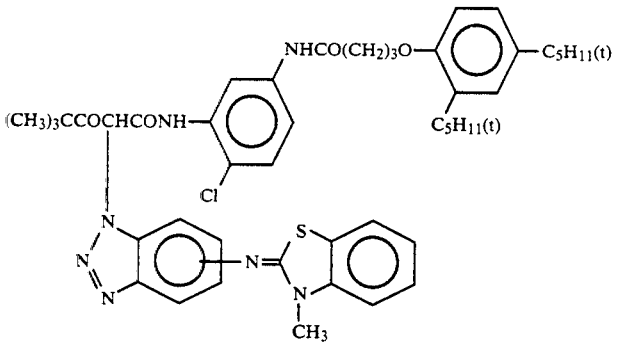
ExM-12
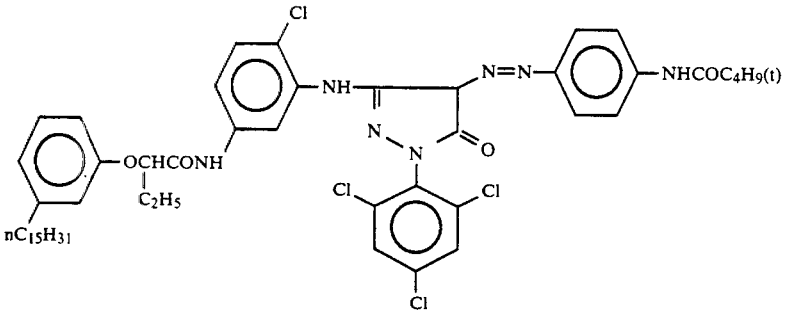
ExY-13
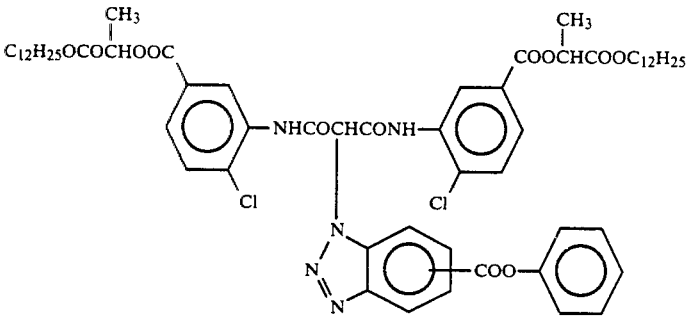
ExM-14
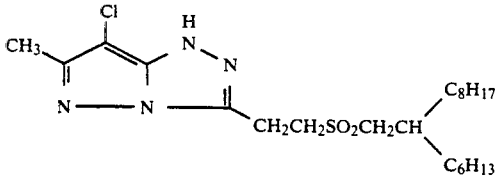

-continued
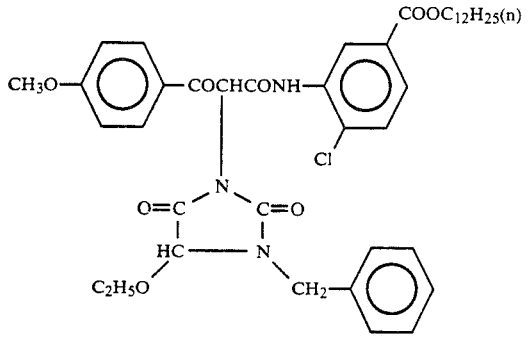
ExY-15
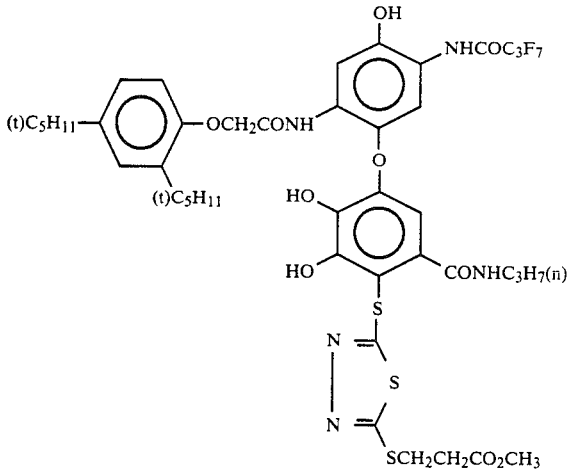
ExC-16
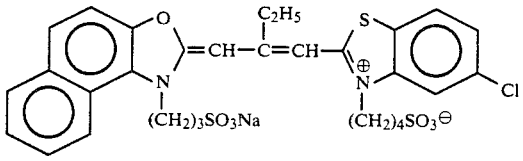
ExS-1
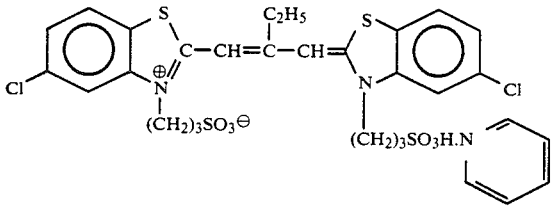
ExS-2
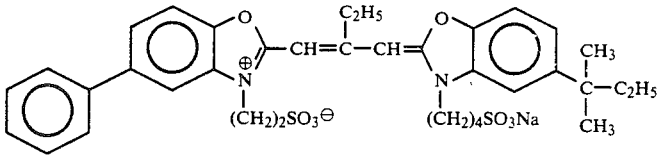
ExS-3
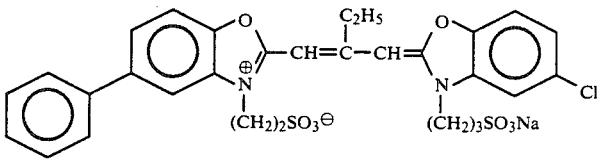
ExS-4

-continued

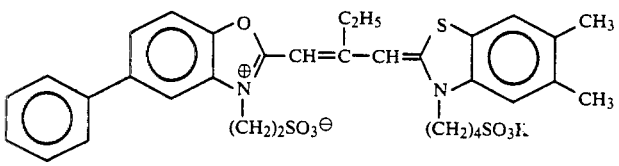

ExS-5

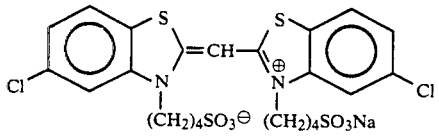

ExS-6

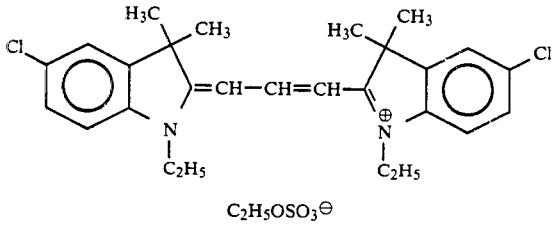

ExF-1

Preparation of Samples 102 to 104

Samples 102 to 104 were prepared in the same way as Sample 101 except that the amount of Film Hardening Agent H-7 added to the fourteenth Layer was changed as shown in Table 1.

Preparation of Samples 105 to 120

Samples 105 to 120 were prepared in the same way as Sample 101 except that the couplers shown in Table 1 were used in a half molar quantity in place of Coupler ExC-2 in the third layer, and in an equimolar quantity in place of Coupler ExC-7 in the fourth layer, respectively, and the amount of Film Hardening Agent H-7 added to the fourteenth layer and the type of film hardening agent were varied as shown in Table 1.

A standard photographic subject was then photographed continuously using a 35 mm size Super HR-100 film made by the Fuji Photo Film Co., Ltd. and 500 meters of this film was processed using the processing operations indicated below.

After the end of this run, Samples 101 to 120 which had been cut to the 35 mm size were exposed at 20 CMS to white light and then they were processed in the same way in the baths in which the above-mentioned processing run had been completed. However, on this occasion the time in the bleach bath was 45 seconds and the time in the bleach-fix bath was 2 minutes 15 seconds.

| Processing Operation I | | | | |
|---|---|---|---|---|
| Process | Time | Temperature (°C.) | Replenishment Rate (ml) | Tank Capacity (l) |
| Color Development | 3 min 15 sec | 38 | 45 | 10 |
| Bleach | 1 min 00 sec | 38 | 20 | 4 |
| Bleach-Fix | 3 min 15 sec | 38 | 30 | 8 |
| Water Wash (1) | 40 sec | 35 | Counter-flow system from (2) to (1) | 4 |
| Water Wash (2) | 1 min 00 sec | 35 | 30 | 4 |
| Stabilization | 40 sec | 38 | 20 | 4 |
| Drying | 1 min 15 sec | 55 | | |

(Replenishment rates per 1 m length of 35 mm wide film)

The compositions of the processing baths are indicated below.

| Color Development Bath | Tank Solution | Replenisher |
|---|---|---|
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-(N-Ethyl-N-β-hydroxyethylamino)-2-methylaniline Sulfate | 4.5 g | 5.5 g |
| Water to make | 1.0 l | 1.0 l |
| pH | 10.05 | 10.10 |

| Bleach Bath (Common to Tank Solution and Replenisher) | |
|---|---|
| Ethylenediaminetetraacetic Acid Ferric Ammonium Salt (dihydrate) | 120.0 g |
| Ethylenediaminetetraacetic Acid Disodium Salt | 10.0 g |
| Ammonium Bromide | 100.0 g |
| Ammonium Nitrate | 10.0 g |
| Bleach Accelerator as Indicated Below | 0.005 mol |

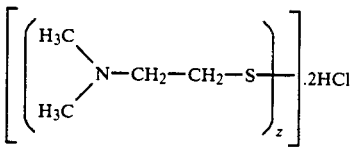

| | |
|---|---|
| Aqueous Ammonia (27%) | 15.0 ml |
| Water to make | 1.0 l |
| pH | 6.3 |

Bleach-Fix Bath

-continued

| (Common to Tank Solution and Replenisher) | |
|---|---|
| Ethylenediaminetetraacetic Acid Ferric Ammonium Salt (dihydrate) | 50.0 g |
| Ethylenediaminetetraacetic Acid Disodium Salt | 5.0 g |
| Sodium Sulfite | 12.0 g |
| Aqueous Ammonium Thiosulfate Solution (70%) | 240.0 ml |
| Aqueous Ammonia (27%) | 6.0 ml |
| Water to make | 1.0 l |
| pH | 7.2 |

Water Wash Baths (Common to Tank Solution and Replenisher)

City water was passed through a mixed bed column packed with an H type strongly acidic cation exchange resin ("Amberlite IR-120B", made by the Rohm & Haas Co.) and an OH type anion exchange resin ("Amberlite IR-400", made by the Rohm & Haas Co.) to reduce the calcium and magnesium ion concentration to less than 3 mg/liter, after which 20 mg/liter of chlorinated sodium isocyanurate and 0.15 g/liter of sodium sulfate were added.

The pH of this bath ranged from 6.5 to 7.5.

Stabilizer Bath (Common to Tank Solution and Replenisher)

| | |
|---|---|
| Formalin (37%) | 2.0 ml |
| Polyoxyethylene-p-monononylphenol Ether (average degree of polymerization: 10) | 0.3 g |
| Ethylenediaminetetraacetic Acid Disodium Salt | 0.05 g |
| Water to make | 1.0 l |
| pH | 5.0–8.0 |

The residual silver contents of the developed samples were analyzed using X-ray fluorescence. The results obtained are shown in Table 1.

It is clear from Table 1 that when couplers of this invention are used and the swelling factor is at least 2.8, the desilvering rate is increased, and even when the bleaching process is shortened, the materials have sufficient desilvering properties.

EXAMPLE 2

Running tests were carried out using Super HR-100 film in the same way as in Example 1 except that processing operation II indicated below was used. After completing the running test, Samples 101 to 120 were passed in the same way through the running processing baths so obtained and the residual silver contents were measured. It is known that materials are more or less satisfactory in practice when the residual silver content is less than some 3 to 4 $\mu g/cm^2$. The results obtained are shown in Table 1.

Processing Operation II

| Process | Time | Temperature (°C.) | Replenishment Rate (ml) | Tank Capacity (l) |
|---|---|---|---|---|
| Color Development | 2 min 30 sec | 40 | 10 | 8 |
| Bleach-Fix | 3 min 00 sec | 40 | 20 | 8 |
| Water Wash (1) | 20 sec | 35 | Counter-flow system from (2) to (1) | 2 |
| Water Wash (2) | 20 sec | 35 | 10 | 2 |
| Stabilization | 20 sec | 35 | 10 | 2 |
| Drying | 50 sec | 65 | | |

(Replenishment rates per 1 m length of 35 mm wide film)

The compositions of the processing baths are indicated below.

| Color Development Bath | Tank Solution | Replenisher |
|---|---|---|
| Diethylenetriaminepentaacetic Acid | 2.0 g | 2.2 g |
| 1-Hydroxyethylidene-1,1-diphosphonic Acid | 3.0 g | 3.2 g |
| Sodium Sulfite | 4.0 g | 5.5 g |
| Potassium Carbonate | 30.0 g | 45.0 g |
| Potassium Bromide | 1.4 g | — |
| Potassium Iodide | 1.5 mg | — |
| Hydroxylamine Sulfate | 2.4 g | 3.0 g |
| 4-(N-Ethyl-N-β-hydroxyethylamino)-2-methylaniline Sulfate | 4.5 g | 7.5 g |
| Water to make | 1.0 l | 1.0 l |
| pH | 10.05 | 10.20 |

Bleach-Fix Bath
(Common to Tank Solution and Replenisher)

| | |
|---|---|
| Ethylenediaminetetraacetic Acid Ferric Ammonium Salt (dihydrate) | 90.0 g |
| Ethylenediaminetetraacetic Acid Disodium Salt | 5.0 g |
| Sodium Sulfite | 12.0 g |
| Aqueous Ammonium Thiosulfate Solution (70%) | 260.0 ml |
| Acetic Acid (98%) | 5.0 ml |
| Bleach Accelerator | 0.01 mol |

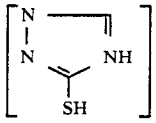

| | |
|---|---|
| Water to make | 1.0 l |
| pH | 6.0 |

Water Wash Baths (Common to Tank Solution and Replenisher)

City water was passed through a mixed bed column packed with an H type strongly acidic cation exchange resin ("Amberlite IR-120B", made by the Rohm & Haas Co.) and an OH type anion exchange resin ("Amberlite IR-400", made by the Rohm & Haas Co.) to reduce the calcium and magnesium ion concentration to less than 3 mg/liter, after which 20 mg/liter of chlorinated sodium isocyanurate and 0.15 g/liter of sodium sulfate were added.

The pH of this bath ranged from 6.5 to 7.5.

Stabilizer Bath (Common to Tank Solution and Replenisher)

| | |
|---|---|
| Formalin (37%) | 2.0 ml |
| Polyoxyethylene-p-monononylphenol Ether (average degree of polymerization: 10) | 0.3 g |
| Ethylenediaminetetraacetic Acid Disodium Salt | 0.05 g |
| Water to make | 1.0 l |

-continued

| Stabilizer Bath (Common to Tank Solution and Replenisher) | |
|---|---|
| pH | 5.0–8.0 |

TABLE 1

| Sample No. | Couplers in Third and Fourth Layers | Film Hardening Agent (wt/wt with respect to gelatin) | Swelling Factor | Residual Silver Content Process I ($\mu g/cm^2$) | Residual Silver Content Process II ($\mu g/cm^2$) |
|---|---|---|---|---|---|
| 101 (Comparison) | ExC-2/ExC-7 | H-7 (5%) | 2.40 | 40 | 52 |
| 102 (Comparison) | " | H-7 (4%) | 2.61 | 32 | 46 |
| 103 (Comparison) | " | H-7 (3.5%) | 2.81 | 25 | 43 |
| 104 (Comparison) | " | H-7 (3%) | 2.93 | 18 | 41 |
| 105 (Comparison) | B-20 | H-7 (5%) | 2.41 | 13 | 22 |
| 106 (Comparison) | " | H-7 (4%) | 2.60 | 10 | 15 |
| 107 (Invention) | " | H-7 (3.5%) | 2.82 | 4 | 6 |
| 108 (Invention) | " | H-7 (3%) | 2.95 | 2 | 3 |
| 109 (Comparison) | B-46 | H-7 (5%) | 2.44 | 12 | 16 |
| 110 (Comparison) | " | H-7 (4%) | 2.62 | 8 | 10 |
| 111 (Invention) | " | H-7 (3.5%) | 2.83 | 3 | 3 |
| 112 (Invention) | " | H-7 (3%) | 2.94 | 2 | 3 |
| 113 (Comparison) | B-20 | H-1 (3.5%) | 2.45 | 9 | 16 |
| 114 (Comparison) | " | H-1 (3.0%) | 2.70 | 5 | 11 |
| 115 (Invention) | " | H-1 (2.5%) | 2.85 | 2 | 4 |
| 116 (Invention) | " | H-1 (2%) | 2.97 | 2 | 2 |
| 117 (Comparison) | B-46 | H-1 (3.5%) | 2.42 | 8 | 9 |
| 118 (Comparison) | " | H-1 (3.0%) | 2.69 | 4 | 6 |
| 119 (Invention) | " | H-1 (2.5%) | 2.80 | 2 | 3 |
| 120 (Invention) | " | H-1 (2.0%) | 2.96 | 2 | 2 |

EXAMPLE 3

Samples were prepared using Couplers B-2, B-11, B-18, and B-19 in place of Coupler B-2 of the present invention used in Samples 105 to 108 in Examples 1 and 2. The samples thus prepared were tested in the same manner as in Examples 1 and 2, the results being the same as in Examples 1 and 2.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising:

at least one red-sensitive silver halide emulsion layer;

at least one green-sensitive silver halide emulsion layer; and at least one blue-sensitive silver halide emulsion layer, wherein said layers are coated on a support and wherein said photographic material comprises at least one compound which reacts with the oxidation product of a color developing agent during development and releases a bleach accelerator, and wherein the swelling factor of said photographic material in a development bath is at least 2.8.

2. A silver halide color photographic material according to claim 1, wherein said compound is represented by general formula (I):

$$A-(L)_p-Z \qquad (I)$$

wherein A represents a group whose bond with $(L)_p$—Z is cleaved by reaction with the oxidation product of said developing agent, L is selected from the group consisting of a timing group and a group whose bond with Z is cleaved by reaction with the oxidation product of said developing agent, p represents an integer having a value of from 0 to 3, wherein when p is 2 or 3, the L groups may be the same or different, and Z represents a group which exhibits a bleach accelerating action when the bond between Z and A—$(L)_p$ is cleaved.

3. A silver halide color photographic material according to claim 1, wherein said compound is represented by general formula (I'):

$$A-(L_1)_a-(L_2)_b-Z \qquad (I')$$

wherein A represents a group whose bond with $(L_1)_a$—$(L_2)_b$—Z is cleaved by reaction with the oxidation product of said developing agent, $L_1$ is selected from the group consisting of a timing group and a group whose bond with $(L_2)_b$—Z is cleaved by reaction with the oxidation product of said developing agent, $L_2$ is selected from the group consisting of a timing group and a group whose bond with Z is cleaved by reaction with the oxidation product of said developing agent, Z represents a group which exhibits a bleach accelerating action when the bond between Z and A—$(L_1)_a$—$(L_2)_b$ has been cleaved, and a and b each represents 0 or 1.

4. A silver halide color photographic material according to claim 1, wherein A is a coupler residual group represented by general formulas (Cp-1), (Cp-2), (Cp-3), (Cp-4), (Cp-5), (Cp-6), (Cp-7), (Cp-8), (Cp-9), or (Cp-10):

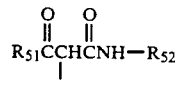
(Cp-1)

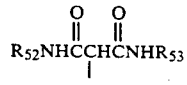
(Cp-2)

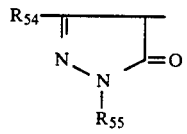
(Cp-3)

-continued

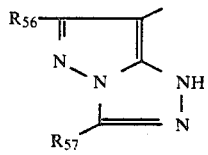

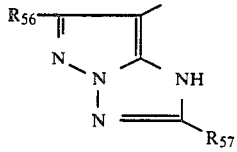

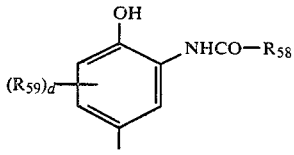

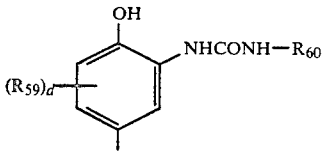

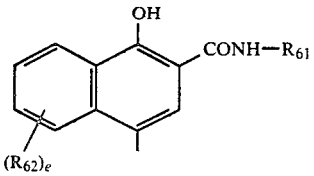

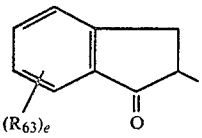

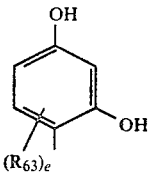

wherein when $R_{41}$ is defined as an aliphatic group, aromatic group or heterocyclic group, $R_{42}$ as an aromatic group or heterocyclic group, and $R_{43}$, $R_{44}$ and $R_{45}$ as hydrogen atoms, aliphatic groups or aromatic groups, $R_{51}$ has the same significance as $R_{41}$; $R_{52}$ and $R_{53}$ each has the same significance as $R_{42}$; $R_{54}$ has the same significance as $R_{41}$ or it represents an $R_{41}CON(R_{43})$— group, an $R_{41}N(R_{43})$— group, an $R_{41}SO_2N(R_{43})$— group, an $R_{41}S$— group, an $R_{43}O$— group, (Cp-4) an $R_{45}N(R_{43})$—CO—$N(R_{44})$— group or an N≡C— group, an $R_{55}$ has the same significance as $R_{41}$; $R_{56}$ and $R_{57}$ each has the same significance as $R_{43}$ or each represents an $R_{41}S$— group, an $R_{43}O$— group, (Cp-5) an $R_{41}CON(R_{43})$— group, or an $R_{41}SO_2N(R_{43})$— group;

$R_{58}$ has the same significance as $R_{41}$; $R_{59}$ has the same significance as $R_{41}$, or it represents (Cp-6) an $R_{41}CON(R_{43})$— group, an $R_{41}OCON(R_{43})$— group, an $R_{41}SO_2N(R_{43})$— group, an $R_{43}N(R_{44})$—CO—$N(R_{45})$— group, (Cp-7) an $R_{41}O$— group, an $R_{41}S$— group, a halogen atom or an $R_{41}N(R_{43})$— group;

(Cp-8) $R_{60}$ has the same significance as $R_{41}$, $R_{61}$ has the same significance as $R_{41}$, $R_{62}$ has the same significance as $R_{41}$, or it represents an $R_{41}CONH$— group, an $R_{41}O$-CONH— group, an $R_{41}SO_2NH$— group, (Cp-9) an $R_{43}N(R_{44})$—CO—$N(R_{45})$— group, an $R_{43}N(R_{44})$—$SO_2$—$N(R_{45})$— group, (Cp-10) an $R_{43}O$— group, an $R_{41}S$— group, a halogen atom, or an $R_{41}N(R_{43})$— group;

$R_{63}$ has the same significance as $R_{41}$, or it represents an $R_{43}CON(R_{45})$— group, an $R_{43}NCO(R_{44})$— group, an $R_{41}SO_2N(R_{44})$— group, an $R_{43}NSO_2(R_{44})$— group, an $R_{41}SO_2$— group, an $R_{43}OCO$— group, an $R_{43}O$—$SO_2$— group, a halogen atom, a nitro group, a cyano group, or an $R_{43}CO$— group; d represents an integer having a value of 0 to 3; and e represents an integer having a value of from 0 to 4.

5. A silver halide color photographic material according to claim 1, wherein said compound is represented by general formula (II):

$$A_1—P—(X=Y)_n—Q—A_2 \quad (II)$$

wherein P and Q each independently represents an oxygen atom or a substituted or unsubstituted imino group, and at least one of the n individual X and Y groups represents a methine group which has a group represented by $-(L_1)_a-(L_2)_b-Z$ as a substituent group and the other X and Y groups represent substituted or unsubstituted methine groups or nitrogen atoms, n is an integer having a value of from 1 to 3 where the n individual X groups and n individual Y groups may be the same or different, and $A_1$ and $A_2$ each represents a hydrogen atom or a group which can be removed with an alkali.

6. A silver halide color photographic material according to claim 5, wherein said compound is represented by general formulae (III) or (IV):

(III)

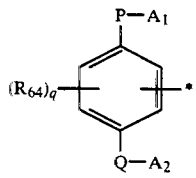

(IV)

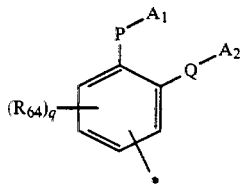

wherein * indicates the position at which the $-(L_1)_a-(L_2)_b-Z$ group is bonded, and P, Q, $A_1$ and $A_2$ have the same significance as described for general formula (II), $R_{64}$ represents a substituent group, and q represents 0 or an integer having a value of from 1 to 3.

7. A silver halide color photographic material according to claim 3, wherein $L_1$ and $L_2$ each is a group represented by formulas (T-1), (T-2), (T-3), (T-4), (T-5), or (T-6):

(T-1)

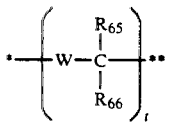

wherein W represents an oxygen atom, a sulfur atom, or an

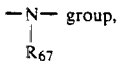

$R_{65}$ and $R_{66}$ each represents a hydrogen atoms or a substituent group, $R_{67}$ represents a substituent group, and t represents 1 or 2;

*—Nu—Link—E—** (T-2)

wherein * indicates the position at which it is bonded on the left hand side in general formula (I'); and  indicates the position at which it is bonded on the right hand side in general formula (II); Nu represents a nucleophilic group; E is an electrophilic group, this being a group which is subjected to nucleophilic attack by Nu and cleaves the bond indicated by the ; and Link is a linking group which establishes a steric arrangement of the groups Nu and E such that an intramolecular nucleophilic substitution reaction can occur;

(T-3)

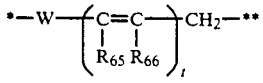

wherein *, **, W, $R_{65}$, $R_{66}$ and t have the same significance as described in connection with general formula (T-1);

(T-4)

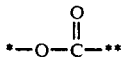

(T-5)

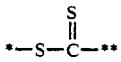

(T-6)

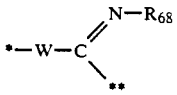

wherein *, **, and W have the same significance as described in connection with general formula (T-1), and $R_{68}$ has the same significance as $R_{67}$.

8. A silver halide color photographic material according to claim 3, wherein $L_1$ and $L_2$ each is a group represented by general formulas (V), (VI), (VII), or (VIII):

(V)

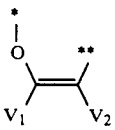

(VI)

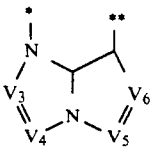

(VII)

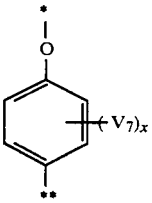

(VIII)

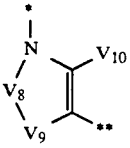

wherein $V_1$ and $V_2$ each represents a substituent group; $V_3$, $V_4$, $V_5$ and $V_6$ each represents a nitrogen atom, or a substituted or unsubstituted methine group; $V_7$ represents a substituent group; x represents an integer having a value of from 0 to 4; $V_8$ represents a —CO— group, an $-SO_2-$ group, a nitrogen atom or a substituted imino group; $V_9$ represents a group of nonmetal atoms which is required together with

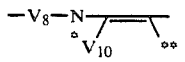

to form a 5- to 8-membered ring; $V_{10}$ represents a hydrogen atom or a substituent group and * indicates the position of bonding on the left hand side in general formula (I'); and ** indicates the position of bonding on the right hand side in general formula (I').

9. A silver halide color photographic material according to claim 3, wherein $L_1$ and $L_2$ each is a group represented by general formulas (X) or (XI):

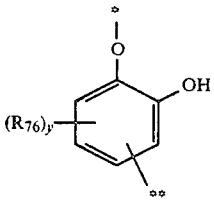

(X)

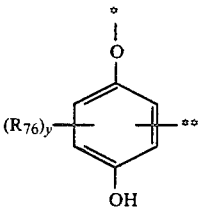

(XI)

wherein * signifies the position of the bonding on the left hand side of $L_1$ and $L_2$ in general formula (I'); ** indicates the position of the bonding on the right hand side; $R_{76}$ represents a substituent group; and y represents an integer having a value of from 0 to 3.

10. A silver halide color photographic material according to claim 3, wherein Z is a group represented by general formulas (XII), (XIII), or (XIV):

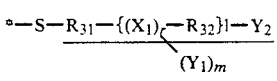

(XII)

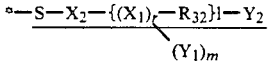

(XIII)

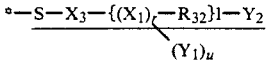

(XIV)

wherein * indicates the position of the bonding with the $A-(L_1)_a-(L_2)_b-$ group; $R_{31}$ represents a divalent aliphatic group which has from 1 to 8 carbon atoms; $R_{32}$ has the same significance as $R_{31}$ and further represents a divalent aromatic group which has from 6 to 10 carbon atoms, or a 3- to 8-membered divalent heterocyclic group; $X_1$ represents

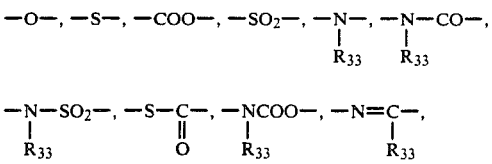

-continued

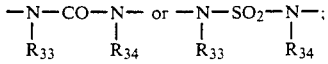

$X_2$ represents an aromatic group which has from 6 to 10 carbon atoms; $X_3$ represents a 3- to 8-membered heterocyclic group which has at least one carbon atom, which is bonded to sulfur, in the ring; $X_1$ represents a carboxyl group or a salt thereof, a sulfo group or a salt thereof, a hydroxyl group, a phosphonic acid group or a salt thereof, an amino group, an $-NHSO_2-R_{35}$ group or an $-SO_2NH-R_{35}$ group; $Y_2$ represents a group which has the same significance as $Y_1$ or a hydrogen atom; r represents 0 or 1; l represents an integer having a value of from 0 to 4; m represents an integer having a value of from 1 to 4; and u represents an integer having a value of from 0 to 4.

11. A silver halide color photographic material according to claim 3, wherein the compound represented by general formula (I') is a polymer derived from a monomer represented by general formula (XV) indicated below which has a repeating unit represented by general formula (XVI), or a copolymer derived from said monomer with at least one type of non-colorforming monomer which has at least one ethylene group which does not have the capacity for coupling with the oxidation product of said primary aromatic amine developing agent:

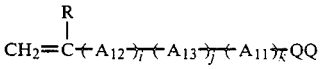

(XV)

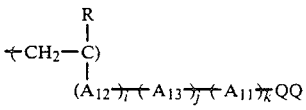

(XVI)

wherein R represents a hydrogen atom, a lower alkyl group which has from 1 to 4 carbon atoms, or a chlorine atom, $A_{11}$ represents —CONH—, —NHCONH—, —NHCOO—, —COO—, $SO_2$—, —CO—, —NHCO—, —$SO_2$NH—, —$NHCO_2$—, —OCO—, —OCONH—, —NH— or —O—, $A_{12}$ represents —CONH— or —COO—, and $A_{13}$ represents an unsubstituted or substituted alkylene group which has from 1 to 10 carbon atoms, an aralkylene group, or an unsubstituted or substituted arylene group;

QQ represents a compound residual group which is represented by general formula (I') in claim 3; and i, j and k represent 0 or 1, but they cannot all represent 0 at the same time.

12. A silver halide color photographic material according to claim 3, wherein the photographic layer of said photographic material has been hardened with a film hardening agent represented by general formula (H):

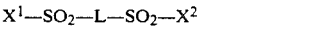

(H)

wherein $X_1$ and $X_2$ each is a $-CH=CH_2$ or a $-CH_2CH_2Y$ group, and they may be the same or different, where Y represents a group which can be substituted by a nucleophilic group or eliminated in the form of HY by means of a base; and L is a divalent linking group which may have a substituent group.

13. A silver halide color photographic material according to claim 12, wherein $X^1$ and $X^2$ each is selected from the group consisting of $-CH=CH_2$, $-CH_2CH_2Cl$, $-CH_2CH_2Br$, $-CH_2CH_2OSO_2CH_3$,

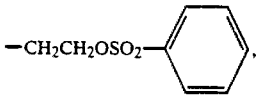

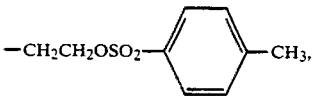

$-CH_2CH_2OSO_3Na$, $-CH_2CH_2OSO_3K$, $-CH_2CH_2OCOCH_3$, $-CH_2CH_2OCOCF_3$, $-CH_2CH_2OCOCHCl_2$, and $-CH_2CH_2N^{\oplus}(C_2H_5)_3Cl^{\ominus}$.

14. A silver halide color photographic material according to claim 12, wherein L is a group selected from the group consisting of:

$$\text{-}(CH_2)_a\text{-}, \quad \text{(L-1)}$$

$$\text{-}(CH_2)_b O (CH_2)_c\text{-}, \quad \text{(L-2)}$$

$$\text{-}(CH_2)_d CON(R^1)(CH_2)_e NCO(CH_2)_f\text{-}, \quad \text{(L-3)}$$

$$\text{-}(CH_2)_g N(R^3)(CH_2)_h\text{-}, \quad \text{(L-4)}$$

-continued $$\text{-}(CH_2)_i CON(R^4)(CH_2)_j O(CH_2)_k NCO(R^5)(CH_2)_l\text{-}, \quad \text{(L-5)}$$

$$\text{-}(CH_2)_m COO(CH_2)_n OCO(CH_2)_p\text{-}, \quad \text{(L-6)}$$

$$\text{-}(CH_2)_q SO_2(CH_2)_r\text{-}, \quad \text{(L-7)}$$

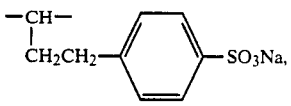

(L-8)

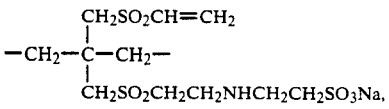

(L-9)

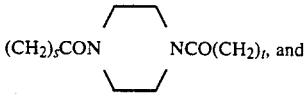

(L-10)

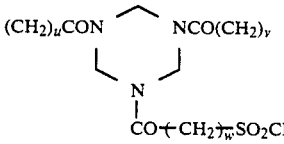

(L-11)

wherein a to d and f to r are integers having a value of from 1 to 6, and e has a value of from 0 to 6; $R^1$ to $R^5$ each is a hydrogen atom, or a substituted or unsubstituted alkyl group which has from 1 to 6 carbon atoms; and $R^1$ and $R^2$, and $R^4$ and $R^5$, may be joined together to form a ring; and s to w each represents an integer having a value of 1 or 2.

* * * * *